US009989337B2

(12) United States Patent
Macher

(10) Patent No.: US 9,989,337 B2
(45) Date of Patent: Jun. 5, 2018

(54) DART SCORING SYSTEM

(71) Applicant: DartConnect LLC, Boston, MA (US)

(72) Inventor: David Macher, Boston, MA (US)

(73) Assignee: DartConnect LLC, Boston, MA (US)

( * ) Notice: Subject to any disclaimer, the term of this patent is extended or adjusted under 35 U.S.C. 154(b) by 181 days.

(21) Appl. No.: 14/832,366

(22) Filed: Aug. 21, 2015

(65) Prior Publication Data

US 2016/0054103 A1 Feb. 25, 2016

Related U.S. Application Data

(60) Provisional application No. 62/040,299, filed on Aug. 21, 2014.

(51) Int. Cl.
*F41J 3/02* (2006.01)
*F41J 3/00* (2006.01)

(52) U.S. Cl.
CPC ..... *F41J 3/02* (2013.01); *F41J 3/0009* (2013.01)

(58) Field of Classification Search
CPC ..... F41J 3/02; F41J 3/0009; A63F 3/00028; A63F 2009/0221; A63B 65/02
See application file for complete search history.

(56) References Cited

U.S. PATENT DOCUMENTS 5,559,490 A 9/1996 McDonald et al.
5,857,912 A 1/1999 Freitag et al.
5,882,111 A * 3/1999 Chen ..... F41J 3/02 273/371
2001/0053722 A1 12/2001 Miller
2003/0064782 A1* 4/2003 Beaulieu ..... G07F 17/32 463/20
2004/0121855 A1* 6/2004 Giegerich ..... F41J 3/02 473/371
2006/0247058 A1 11/2006 Kromer
2011/0109045 A1 5/2011 Su et al.
2012/0101604 A1 4/2012 Segal et al.
2012/0258788 A1* 10/2012 Hong ..... F41J 3/02 463/25
2014/0038729 A1 2/2014 Borge
2016/0084618 A1* 3/2016 Hong ..... F41J 5/14 273/371

FOREIGN PATENT DOCUMENTS

DE 102004016775 A1 10/2005
EP 1473065 A2 11/2004

OTHER PUBLICATIONS

Favero Game-On electronic darts scorer—https://web.archive.org/web/20081014055517/http://www.favero.com/en2_darts_electronic_led_scoreboard_with_infrared_remote_control_for_darts_game-72-25.html, Oct. 18, 2008, also see Game-on brochure.*

(Continued)

*Primary Examiner* — Damon Pierce
(74) *Attorney, Agent, or Firm* — Neugeboren O'Dowd PC

(57) ABSTRACT

A dart game system comprising a steel-tipped dart, a sisal dart board, at least one first mobile computing scoring device comprising a scoring interface, and a remote mobile computing device adapted to receive the scoring interface from the at least one scoring device for display of real-time dart game scores at a remote location.

15 Claims, 31 Drawing Sheets

(56) References Cited

OTHER PUBLICATIONS

Young, Lee W., "International Search Report and Written Opinion re Application No. PCT/US15/46318", dated Jan. 14, 2016, p. 12 Published in: WO.
Wittmann-Regis, Agnes, "International Preliminary Report on Patentability Re Application No. PCT/US2015/046318", dated Mar. 2, 2017, p. 8, Published in: CH.
Gex-Collet, A., "Partial Supplementary European Search Report Re Application No. 15834019.0", Mar. 6, 2018, p. 7, Published in: EP.

* cited by examiner

DCTV More Darts!

Player Performance

DART CONNECT Learn More

MNM Monday Night Metal

| | | | | | |
|---|---|---|---|---|---|
| Date: | Mon, 7-27-15 | Game Time: | 1:01 | Matches: | 1 |
| Start: | 9:17 PM | Match Length: | 1:17 | Games: | 4 |
| End: | 10:34 PM | DER: | 80% | Darts: | 306 |

*Select Report:* Summary > Game Detail > Player Performance Match Counts > My DCA >

'01 Leaders

| | | |
|---|---|---|
| High Turn | 126 | David Macher |
| High DO | 2 | David Macher |
| | | David Macher |

High Points Per Round

| | | |
|---|---|---|
| High PPR (S) | 35 | David Macher |

Cricket Leaders

| | | |
|---|---|---|
| High Turn | 5M | David Macher x 2 |
| Bulls | 7 | David Macher |
| Triples | 5 | David Macher |

High Marks Per Round

| | | |
|---|---|---|
| High MPR (S) | 2.86 | David Macher |

| Players | Match | | | All '01 Games | | | All Cricket Games | | |
|---|---|---|---|---|---|---|---|---|---|
| | Games | Wins | Win % | Points | Darts | PPR | Marks | Darts | MPR |
| Jung Mike | 4 | 0 | 0% | 986 | 102 | 29.0 | 23 | 51 | 1.4 |
| Macher David | 4 | 4 | 100% | 1,002 | 102 | 29.5 | 45 | 51 | 2.6 |

*An email address is required for DartConnect to calculate, report and deliver player performance data. Membership is required for league statistics, select reporting features and trend analysis. Confirm your email address on the device that hosted this match & join DartConnect today!*

| Game | Player | C | P-3DA | 3DA | PDD | T | WA | RD | CO | S9 | FR | DT | PT8 | MKS | 180 | HT | 9M |
|---|---|---|---|---|---|---|---|---|---|---|---|---|---|---|---|---|---|
| 1.1 501 SIDO | David Macher | | | 25.5 | 8.5 | 2 | W | 20 | 2 | 501 | | 59 | 501 | | | | |
| | Mike Jung | | | 24.8 | 8.3 | 1 | | | | 501 | 5 | 60 | 496 | | | | |
| 1.2 501 SIDO | David Macher | | | 35.0 | 11.7 | 1 | W | 15 | 2 | 501 | | 43 | 501 | | | | |
| | Mike Jung | | | 35.0 | 11.7 | 2 | | | | 501 | 11 | 42 | 490 | | | | |
| 1.3 Cricket | David Macher | | | 2.5 | 0.8 | 2 | W | 10 | | 0M | | 29 | | 24M | | | |
| | Mike Jung | | | 1.3 | 0.4 | 1 | | | | 0M | | 30 | | 13M | | | |
| 1.4 Cricket | David Macher | | | 2.9 | 1.0 | 1 | W | 8 | | 0M | | 22 | | 21M | | | |
| | Mike Jung | | | 1.4 | 0.5 | 2 | | | | 0M | | 21 | | 10M | | | |

DCTV More Darts!

Match Counts

DART CONNECT Learn More

MNM Monday Night Metal

| | | | | | |
|---|---|---|---|---|---|
| Date: | Mon, 7-27-15 | Game Time: | 1:01 | Matches: | 1 |
| Start: | 9:17 PM | Match Length: | 1:17 | Games: | 4 |
| End: | 10:34 PM | DER: | 80% | Darts: | 306 |

Select Report: Summary > Game Detail > Player Performance > Match Counts My DCA >

| Opponents | Match | | | All '01 Games | | | All Cricket Games | | |
|---|---|---|---|---|---|---|---|---|---|
| | Score | Sets | Games | Points | Darts | PPR | Marks | Darts | MPR |
| David M | 4 | 1 | 4 | 1,002 | 102 | 29.5 | 45 | 51 | 2.6 |
| Mike J | 0 | | | 986 | 102 | 29.0 | 23 | 51 | 1.4 |
| All Games Played (AGP) | n/a | 1 | 4 | 1,988 | 204 | 29.2 | 68 | 102 | 2.0 |

*An email address is required for DartConnect to calculate, report and deliver player performance data. Membership is required for league statistics, select reporting features and trend analysis. Confirm your email address on the device that hosted this match & join DartConnect today!*

60+ Double-Ins

| High | Count | 60-99 | 100-139 | 140+ |
|---|---|---|---|---|

60+ Double-Outs

| High | Count | 60-99 | 100-139 | 140+ |
|---|---|---|---|---|

'01 100+ Turns

| | Points | Count | High Turn | 100-119 | 120-139 | 140-169 | 160-179 | 180 |
|---|---|---|---|---|---|---|---|---|
| Jung, Mike | 126 | 1 | 126 | | 1 | | | |
| Macher, David | 100 | 1 | 100 | 1 | | | | |

'01 95+ Turns

| | Points | Count | High Turn | 95-113 | 114-132 | 133-161 | 162-179 | 171-180 |
|---|---|---|---|---|---|---|---|---|
| Jung, Mike | 126 | 1 | 126 | | 1 | | | |
| Macher, David | 100 | 1 | 100 | 1 | | | | |

Cricket 5M+ Turns

| | H Mark Total | Count | 5M-% | 5 Marks | 6 Marks | 7 Marks | 8 Marks | 9 Marks |
|---|---|---|---|---|---|---|---|---|
| Macher, David | 12 | 2 | 11% | | 2 | | | |

| | Cricket Bulls | | | | | Marksman Counts | | |
|---|---|---|---|---|---|---|---|---|
| | All Bulls | 3 Bulls | 4 Bulls | 5 Bulls | 6 Bulls | Triples | D. Bulls | Hat Tricks |
| Macher, David | 7 | 1 | | | | 5 | 2 | |
| Jung, Mike | 2 | | | | | 2 | | |

FIG. 24

DCTV More Darts!

Match Summary

DART CONNECT Learn More

MNM Monday Night Metal

| | | | | | |
|---|---|---|---|---|---|
| Date: | Mon, 7-27-15 | Game Time: | 1:01 | Matches: | 1 |
| Start: | 9:17 PM | Match Length: | 1:17 | Games: | 4 |
| End: | 10:34 PM | DER: | 80% | Darts: | 306 |

*Select Report:* Summary  Game Detail >  Player Performance >  Match Counts >  My DCA >

| Opponents | Match Score | Match Sets | Match Games | All '01 Games Points | All '01 Games Darts | All '01 Games PPR | All Cricket Games Marks | All Cricket Games Darts | All Cricket Games MPR |
|---|---|---|---|---|---|---|---|---|---|
| David M | 4 | 1 | 4 | 1,002 | 102 | 29.5 | 45 | 51 | 2.6 |
| Mike J | 0 | | | 986 | 102 | 29.0 | 23 | 51 | 1.4 |
| All Games Played (AGP) | n/a | 1 | 4 | 1,988 | 204 | 29.2 | 68 | 102 | 2.0 |

| GAME | 3DA | David M Players | Score | Score | Mike J Players | 3DA | Darts |
|---|---|---|---|---|---|---|---|
| 1.1 | 25.5 | David Macher | ◊ 0 | 501 | 5 | Mike Jung | 24.8 | 59 |
| 1.2 | 35.0 | | ◊ 0 | 501 | 11 | | 35. | 43 |
| 1.3 | 2.5 | | ◊ 60 | Cricket | 0 | | 1.3 | 29 |
| 1.4 | 2.9 | | ★ 0 | Cricket | 0 | | 1.4 | 22 |

Match ID: 55b6e8c2e0ee1f50076dbef9

*Did everyone in the match receive a copy of the match recap?*

*An email address is required for DartConnect to calculate, report and deliver player performance data. Membership is required for league statistics, select reporting features and trend analysis. Confirm your email address on the device that hosted this match & join DartConnect today!*

| Home/Host Players | | Away/Guest Players | |
|---|---|---|---|
| David Macher | Member | Mike Jung | Premium |

DCTV More Darts!

Game Detail

DART CONNECT Learn More

MNM Monday Night Metal

| | | | | | |
|---|---|---|---|---|---|
| Date: | Mon, 7-27-15 | Game Time: | 1:01 | Matches: | 1 |
| Start: | 9:17 PM | Match Length: | 1:17 | Games: | 4 |
| End: | 10:34 PM | DER: | 80% | Darts: | 306 |

Select Report:  Summary >  Game Detail  Player Performance >  Match Counts >  My DCA >

| Opponents | Match Score | Match Sets | Match Games | All '01 Games Points | All '01 Games Darts | All '01 Games PPR | All Cricket Games Marks | All Cricket Games Darts | All Cricket Games MPR |
|---|---|---|---|---|---|---|---|---|---|
| David M | 4 | 1 | 4 | 1,002 | 102 | 29.5 | 45 | 51 | 2.6 |
| Mike J | 0 | | | 986 | 102 | 29.0 | 23 | 51 | 1.4 |
| All Games Played (AGP) | n/a | 1 | 4 | 1,988 | 204 | 29.2 | 68 | 102 | 2.0 |

*An email address is required for DartConnect to calculate, report and deliver player performance data. Membership is required for league statistics, select reporting features and trend analysis. Confirm your email address on the device that hosted this match & join DartConnect today!*

*Green: First Turn  Gold: Opponent s) won the cork.  Red: Game winning turn*

David M — DART CONNECT — Mike J

Game 1.1 - 501 SIDO  ◊ 0 - 5  20:00

| ! | Player | Turn | Score | Rnd | Score | Turn | Player | ! |
|---|---|---|---|---|---|---|---|---|
| | David Macher | 45 | 456 | 1 | 472 | 29 | Mike Jung | |
| | David Macher | 60 | 396 | 2 | 426 | 46 | Mike Jung | |
| | David Macher | 60 | 336 | 3 | 411 | 15 | Mike Jung | |
| | David Macher | 65 | 271 | 4 | 392 | 19 | Mike Jung | |
| | David Macher | 25 | 246 | 5 | 266 | 126 | **Mike Jung** | **126** |
| | David Macher | 26 | 220 | 6 | 258 | 10 | Mike Jung | |
| | David Macher | 30 | 190 | 7 | 232 | 22 | Mike Jung | |
| | David Macher | 45 | 145 | 8 | 203 | 31 | Mike Jung | |
| | David Macher | 79 | 66 | 9 | 127 | 76 | Mike Jung | |
| | David Macher | 26 | 40 | 10 | 91 | 36 | Mike Jung | |
| | David Macher | 20 | 20 | 11 | 49 | 42 | Mike Jung | |
| | David Macher | 10 | 10 | 12 | 10 | 39 | Mike Jung | |
| | David Macher | X | 10 | 13 | 10 | X | Mike Jung | |
| | David Macher | X | 10 | 14 | 10 | X | Mike Jung | |
| | David Macher | 5 | 5 | 15 | 10 | X | Mike Jung | |
| | David Macher | X | 5 | 16 | 10 | X | Mike Jung | |
| | David Macher | X | 5 | 17 | 10 | X | Mike Jung | |
| | David Macher | 3 | 2 | 18 | 10 | X | Mike Jung | |
| | David Macher | X | 2 | 19 | 5 | 5 | Mike Jung | |
| **DO** | **David Macher** | 2 | 0 | 20 | 5 | X | Mike Jung | |

25.5  Darts: 59  3 Dart Avg  24.8

FIG. 25

DartConnect Recap
To: David
David M (4) vs. Mike J (0)

July 27, 2015 10:35 PM
Hide Details
Inbox - iCloud

DART CONNECT

Score.
Track.
Connect.

David,

Here is a link to a summary of the DartConnect match you just completed:

http://members.dartconnect.com/history/report/match/55b6e8c2edee1/50076dbef9

Thank you for your support - Shoot Well!

The DartConnect Team
support@dartconnect.com www.dartconnect.com

*To keep up with the latest developments and releases, Like us on Facebook or follow DartConnect on Twitter.*

2626

FIG. 26

Patriot Dart League
Where Accuracy Counts

Stars & Stripes 2015 Shootout

DART CONNECT
PERFECT YOUR GAME

'01 Leaders

| 01 Leg Victories % | | | |
|---|---|---|---|
| 1 | Caisse, S | 100 | |
| 2 | Deiana, J | 100 | * |
| 3 | Hamel, B | 100 | |
| 4 | Keogh, J | 100 | |
| 5 | Morehouse, J | 100 | |
| 6 | Perkins, M | 100 | * |
| 7 | Roy, J | 100 | |
| 8 | Demers, J | 90 | * |
| 9 | Payne, G | 89 | * |
| 10 | Curtin, T | 84 | * |

| Event PPR | | | |
|---|---|---|---|
| 1 | Roy, J | 86.2 | |
| 2 | Deiana, J | 84.8 | * |
| 3 | Consalvo, P | 80.1 | * |
| 4 | Curtin, T | 77.7 | * |
| 5 | Vye, S | 76.9 | * |
| 6 | Kelley, J | 75.3 | |
| 7 | Ellison, T | 75.0 | * |
| 8 | Brousseau, C | 74.8 | |
| 9 | Sawyer, T | 73.2 | * |
| 10 | Remick, L | 71.6 | * |

| Set PPR (3+ Legs) | | | |
|---|---|---|---|
| 1 | Curtin, T | 88.6 | * |
| 2 | Curtin, T | 87.1 | * |
| 3 | Sawyer, T | 86.0 | * |
| 4 | Kelley, J | 84.7 | |
| 5 | Consalvo, P | 80.1 | |
| 6 | Remick, L | 77.2 | * |
| 7 | Brousseau, C | 74.8 | |
| 8 | Gaudreau, B | 74.0 | |
| 9 | Sawyer, T | 73.5 | * |
| 10 | Sawyer, T | 73.2 | * |

| High 501 PPR (Singles) | | | |
|---|---|---|---|
| 1 | Curtin, T | 117.0 | * |
| 2 | Sawyer, T | 110.5 | * |
| 3 | Curtin, T | 107.4 | * |
| 4 | Sawyer, T | 100.5 | * |
| 5 | Sawyer, T | 100.5 | * |
| 6 | Curtin, T | 93.9 | * |
| 7 | Curtin, T | 93.3 | * |
| 8 | Sawyer, T | 92.0 | * |
| 9 | Thoits, R | 91.5 | |
| 10 | Sawyer, T | 91.3 | * |

2015 Stars & Stripes Shootout
Andover, MA
July 17 - 19

DartConnect Numbers

| | |
|---|---|
| DC Matches | 109 |
| Players Scored | 133 |
| 01 Legs | 239 |
| 01 Darts | 8,280 |
| 01 Points | 128,010 |
| Event PPR | 46 |
| Cricket Legs | 180 |
| Cricket Darts | 8,201 |
| Cricket Marks | 6,270 |
| Event MPR | 2.3 |

2727

*Thanks to the members and volunteers who helped make this report possible, especially those who brought a tablet to the event. Data may be incomplete or subject to input errors and is intended to be representative of the event.*

Performance Highlights

| Total Points | | | |
|---|---|---|---|
| 1 | Sawyer, T | 10884 | * |
| 2 | Curtin, T | 7723 | * |
| 3 | Remick, L | 4724 | * |
| 4 | Gaudreau, B | 4087 | |
| 5 | Briggs, V | 3826 | * |
| 6 | Balcom, K | 3505 | * |
| 7 | Provencal, K | 3289 | |
| 8 | Walsh, D | 3044 | * |
| 9 | Demers, J | 2949 | * |
| 10 | Terry, D | 2423 | * |

| Total 100+ Points | | | |
|---|---|---|---|
| 1 | Sawyer, T | 4261 | * |
| 2 | Curtin, T | 3975 | * |
| 3 | Guadreau, B | 1786 | |
| 4 | Remick, L | 1359 | * |
| 5 | Briggs, V | 964 | * |
| 6 | Walsh, D | 923 | * |
| 7 | McKeon, P | 821 | * |
| 8 | Kelley, J | 780 | |
| 9 | Provencal, K | 661 | * |
| 10 | Amaral, S | 587 | * |

| 100+ Count | | | |
|---|---|---|---|
| 1 | Sawyer, T | 36 | * |
| 2 | Curtin, T | 33 | * |
| 3 | Gaudreau, B | 15 | |
| 4 | Remick, L | 12 | * |
| 5 | Briggs, V | 8 | * |
| 6 | Walsh, D | 8 | * |
| 7 | Kelley, J | 7 | |
| 8 | McKeon, P | 7 | * |
| 9 | Amaral, S | 5 | * |
| 10 | Provencal, K | 5 | * |

| 180's/High Turn | | | |
|---|---|---|---|
| 1 | Sawyer, T | 3X | * |
| 2 | Curtin, T | 2X | * |
| 3 | Remick, T | 1X | * |
| 4 | Gaudreau, B | 157 | |
| 5 | Provencal, K | 156 | * |

| High DO | | | |
|---|---|---|---|
| 1 | Gaudreau, B | 157 | |
| 2 | Curtin, T | 128 | * |
| 3 | Sawyer, T | 108 | * |
| 4 | Terry, P | 104 | |
| 5 | Briggs, V | 100 | * |
| 6 | Payne, G | 87 | |
| 7 | Remick, L | 87 | * |
| 8 | Walsh, D | 80 | * |
| 9 | McCandless, K | 68 | * |
| 10 | McCandless, H | 66 | |
| | Smith Davis, T | 66 | * |

** Indicates players who are par t of the DartConnect Launch Team*
*- Congrats to Staff & Volunteers on their Inaugural Event!*

*For additional details of this event, go to:*
*http://app.dartconnect.com/dctvlistings/tournaments.html*

DCTV

FIG. 27

DART SCORING SYSTEM

PRIORITY

This application claims priority to U.S. Provisional Application No. 62/040,299, filed Aug. 21, 2014 and entitled "Dart Scoring System", which is incorporated herein by reference in its entirety.

FIELD OF THE INVENTION

This invention is related to the game of darts. In particular, but not by way of limitation, the invention is related to providing a scoring system for various dart games.

BACKGROUND OF THE INVENTION

The game of darts is traditionally an English pub game in which each player takes turns throwing 3 steel-tipped throwing devices (i.e., "darts") at various targets on a bristle board containing 20 segments and bulls eye. The two primary games played in the United States are titled '01 ("oh-one") and Cricket.

Historically, scoring was done on chalkboards and more recently, dry erase boards. Although electronic wall-mounted score machines have been developed, they can be expensive and many have a steep learning curve. Furthermore, electronic soft tip machines use special darts and special scoreboards to automatically record scores when the darts hit the board. These are akin to video games, often requiring money for each game and requiring players go to specific establishments having such scoreboards.

Additionally, dart software programs (i.e., applications) typically have a narrow focus and their interfaces tend to be technical and difficult to learn as they do not conform to the typical chalkboard/dry erase board scoring system. Team/league and tournament play is especially challenging to accommodate in such software due to the nature of match format variations and group play.

Many additional factors have prevented easy-to-use modern scoring systems from being developed and/or widely accepted. A first of these is math. Scoring a dart game is prone to math errors, which at a minimum slows game play and often results in incorrect scores. It is this particular pain point that is credited for giving rise to the soft-tip electronic vending game industry described above, impacting the popularity of the steel tipped game. A second factor is the existing electronic scoreboards, which, as stated, can be intimidating or confusing, especially for the uninitiated. Confirming and editing recent scores can be very difficult on these systems, due to a lack of instructions. Furthermore, interfaces vary dramatically from traditional chalk board scoring. A third preventing modern scoring systems from wide acceptance is that darts is a hard game to watch. For example, teammates and spectators often struggle with seeing the current score of the match due to legibility, lighting, positioning, and space restrictions. This often prevents spectators from keeping up with the status of a live game. A fourth problem is finding opponents & creating opportunities to play. As with scheduling any joint activity, the logistics of finding an agreeable time and a common meeting point, while managing the personal commitments in life, can make playing darts a challenge. A fifth issue are game rule variations. There are dozens of niche dart games and practice routines with rule variations. The result is that there are hundreds of possibilities of game types, with even identical games going by different names depending on geography.

This difference creates decreased accuracy. Player performance also limits acceptance. Players are not familiar with ways to measure their performance as current player performance measurement tools require additional manual calculations after every game or match and is especially tedious for cricket-based games.

SUMMARY OF THE INVENTION

In order to provide a better mobile computing device dart-gaming experience, a chalkboard has been replicated on a touch screen, while enabling an easy and quick calculation of statistics associated with dart games. Being portable, personal touch screen devices enable darters to play anywhere, anytime, without per-game fees. Such an experience comprises a "real world" casual/league/tournament platform to emulate the look and feel of traditional score boards while providing the convenience & statistics of electronic scorers for the steel tipped dart community.

One embodiment of the invention comprises a dart game system. One dart game system comprises a steel-tipped dart, a sisal dart board, at least one first mobile computing scoring device comprising a scoring interface, and a remote mobile computing device adapted to receive the scoring interface from the at least one scoring device for display of real-time dart game scores at a remote location.

Another embodiment of the invention comprises a method of conducting a dart game. One such method comprises initiating a dart game in at least one location, recording a dart player's scores across a plurality of rounds via a user interface on a mobile computing device, and sharing the user interface and the dart player's scores in a near real-time manner with at least one remote location.

Yet another embodiment of the invention comprises a non-transitory, tangible, computer-readable storage medium, encoded with processor-readable instructions to perform a method of providing information related to a dart game. The method comprises rendering a dart game scoring interface on a mobile computing device, wherein the dart game scoring interface displays at least one current player score and at least one another player score. The method further comprises ensuring that a dart score is entered correctly into the dart game scoring interface by differentiating a color of the at least one current player score from the at least one another player score, displaying each entry to the scoring interface in a scoring interface score window, and at least one of: displaying in an audit trail a sum of each previous entry entered into the score window, and displaying a number of times a user has selected a target. Such a method yet further comprises sharing the dart game scoring interface with a plurality of additional mobile computing devices.

BRIEF DESCRIPTION OF THE DRAWINGS

Various objects and advantages and a more complete understanding of the present invention are apparent and more readily appreciated by reference to the following Detailed Description and to the appended claims when taken in conjunction with the accompanying Drawings wherein:

FIG. 24 depicts a report comprising statistics screen according to one embodiment of the invention;

FIG. 25 depicts a report comprising statistics screen according to one embodiment of the invention;

FIG. 26 depicts a communication according to one embodiment of the invention;

FIG. 27 depicts various statistical leaders according to one embodiment of the invention;

DETAILED DESCRIPTION

Figure 1:
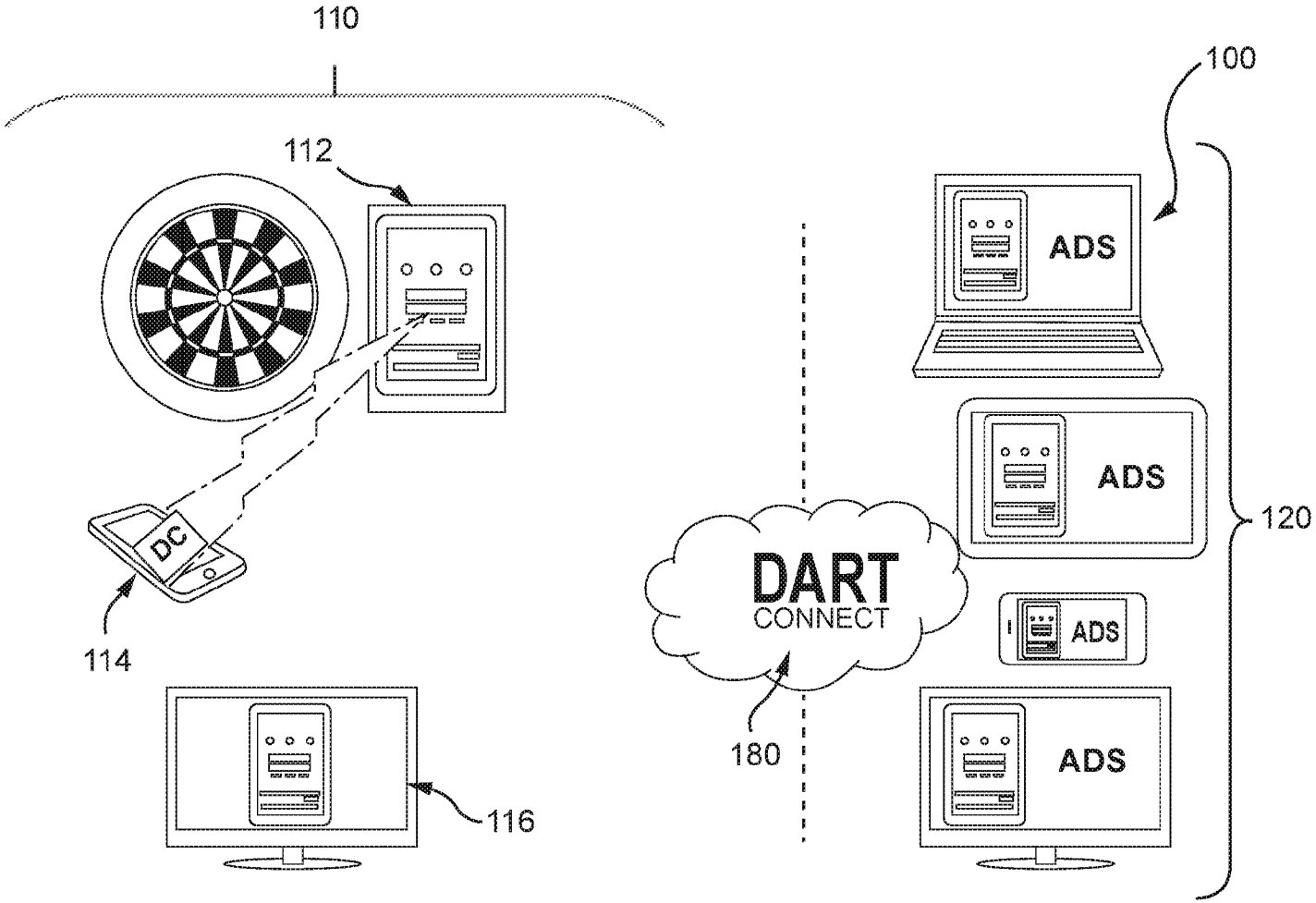
FIG. 1 depicts a dart game system according to one embodiment of the invention.

The dart game system 100 (also referred to herein as a dart scoring system or dart gaming system) seen in FIG. 1 has addressed the issues presented above. For example, the dart gaming system's unique interface substantially decreases the need for math skills and does not interfere with even the most proficient player's game. The dart gaming system 100 may also provide a calculation of your three dart average for all games, including a reference point that compares it to your most recent 3 month average. The dart gaming system's interface makes it easy to score, confirm or edit what was entered on the prior turn. With network access, the dart gaming system's interface can be broadcast to any computing device, allowing spectators who are at a distance or even offsite to follow the score of the game on a public or personal device. Furthermore, with network or internet-enabled devices, the dart gaming system 100 allows two opponents in separate locations to play a game, each taking turns scoring their respective turns. The dart gaming system 100 also provides a custom play option for enabling various game rules, where users have the ability to design games and practice routines to create the version of the game they are accustomed to playing or want to play.

One embodiment of the dart scoring system improves game play and the scoring experience. For example, the dart gaming system 100 captures data and statistics during the scoring of the game, eliminating the need for manual documentation. The dart gaming system 100 further utilizes the cloud to broadcast games for spectators to follow on any internet enabled device and enables game play between 2 opponents in separate locations. League and tournament play is supported with instant results & stats available to administrators, captains and players, and an interactive community is created utilizing the data collected from game play. It is contemplated that the system 100 may be utilized with our without a network connection. For example, when there is a network connection, the system 100 will automatically update the player/league/tournament statistics on a per throw/game/match segment, as identified by the user. However, if no network connection is available, the system stores the information locally and transfers the data to the server 180 up re-establishing a network connection, integrating the information with any previous information stored.

Turning first to FIG. 1, seen is on embodiment of a dart gaming system 100. Although each figure described below may refer to a particular aspect of the dart gaming system 100, it is contemplated that the figure, or a feature thereof, may be referred to as the system 100. As seen in FIG. 1, one dart gaming system 100 comprises on-site solutions 110 and off-site solutions 120. The on-site solutions 110 may comprise a scoreboard 112, mobile device 114 or home device 116, while the off-site solutions 120 may comprise one or more network-enabled or internet-enabled devices. The off-site solutions 120 may also be referred to herein as remote devices or broadcast devices. The use of the system 100 is adapted to provide a quick, easy, and effective dart game scoring mechanism, having the ability to score many niche dart games and/or dart games with one or more regional variation. Each of the devices seen in FIG. 1 may comprise a mobile computing device, a desktop device, or any other computing device known in the art.

Figure 19:
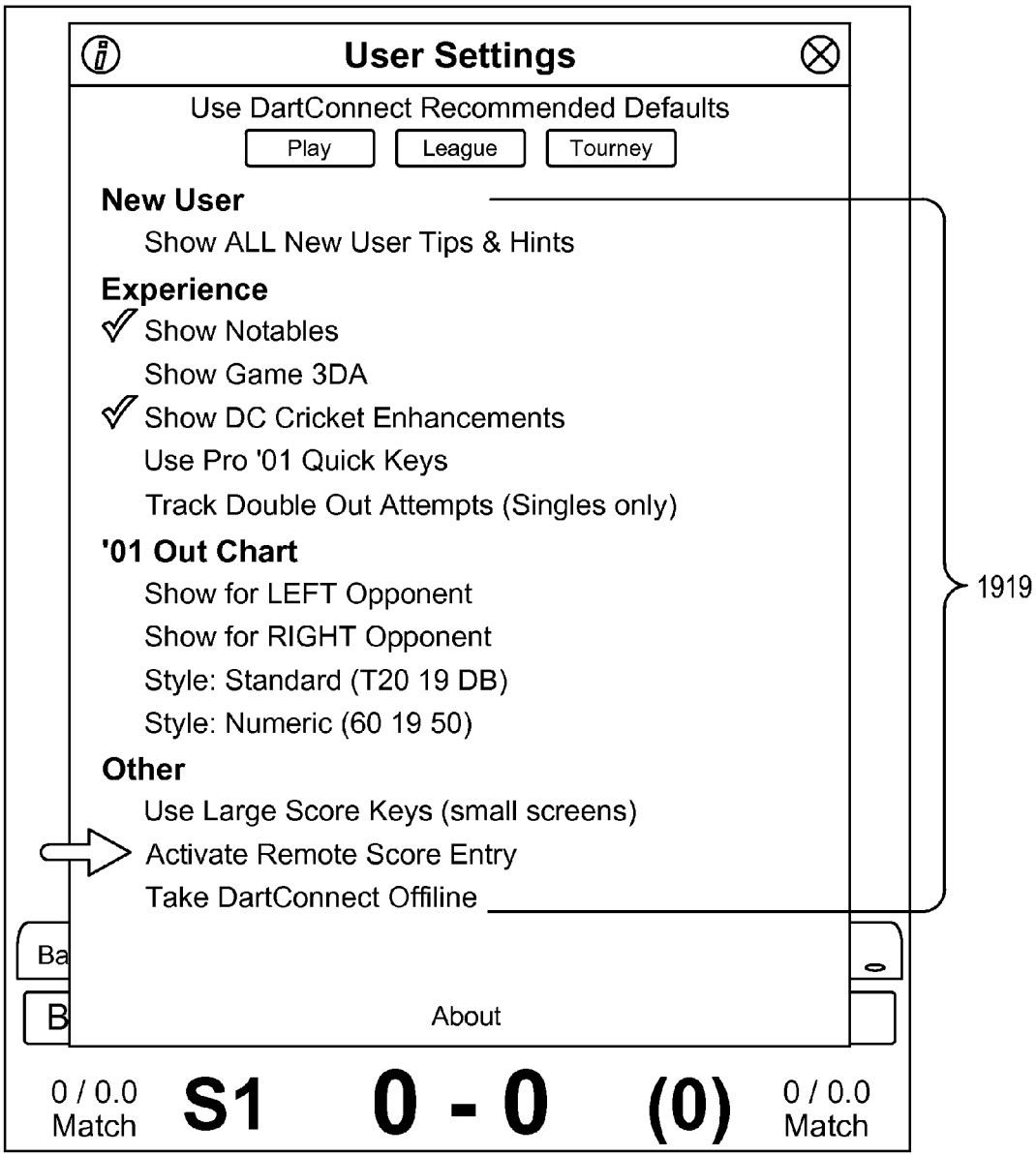
FIG. 19 depicts user settings according to one embodiment of the invention.

In one embodiment, the scoreboard 112 may be used to enter and display a dart game score on a user interface. A server 180 may broadcast the user interface to the remote devices. The home devices 116 may mirror the user interface by as a remote device 120. In addition to the scoreboard, 112, the mobile device 114 may also be used to enter scores onto the user interface. For example, the scoreboard 112 device may be placed near a dart board. In order to enter scores in a safe manner, a player may wish to use his or her handheld mobile device 114 to enter scores into the user interface instead of the scoreboard. However, if a mobile device 114 is used to enter scores, the scoreboard 112 may still control various user settings. Seen in FIG. 19 is one set of user settings 1919 that may be controlled by the scoreboard. One of these user settings 1919 may comprise when the broadcast scores (i.e., the scores on the remote devices 120) are updated. For example, the scores on the broadcast devices may be updated after each dart throw or may be updated after each player, or after each round. Other update scenarios are contemplated. As seen in FIG. 1, the remote devices may comprise advertisements—"ADS", as shown in the figure.

Figure 3:
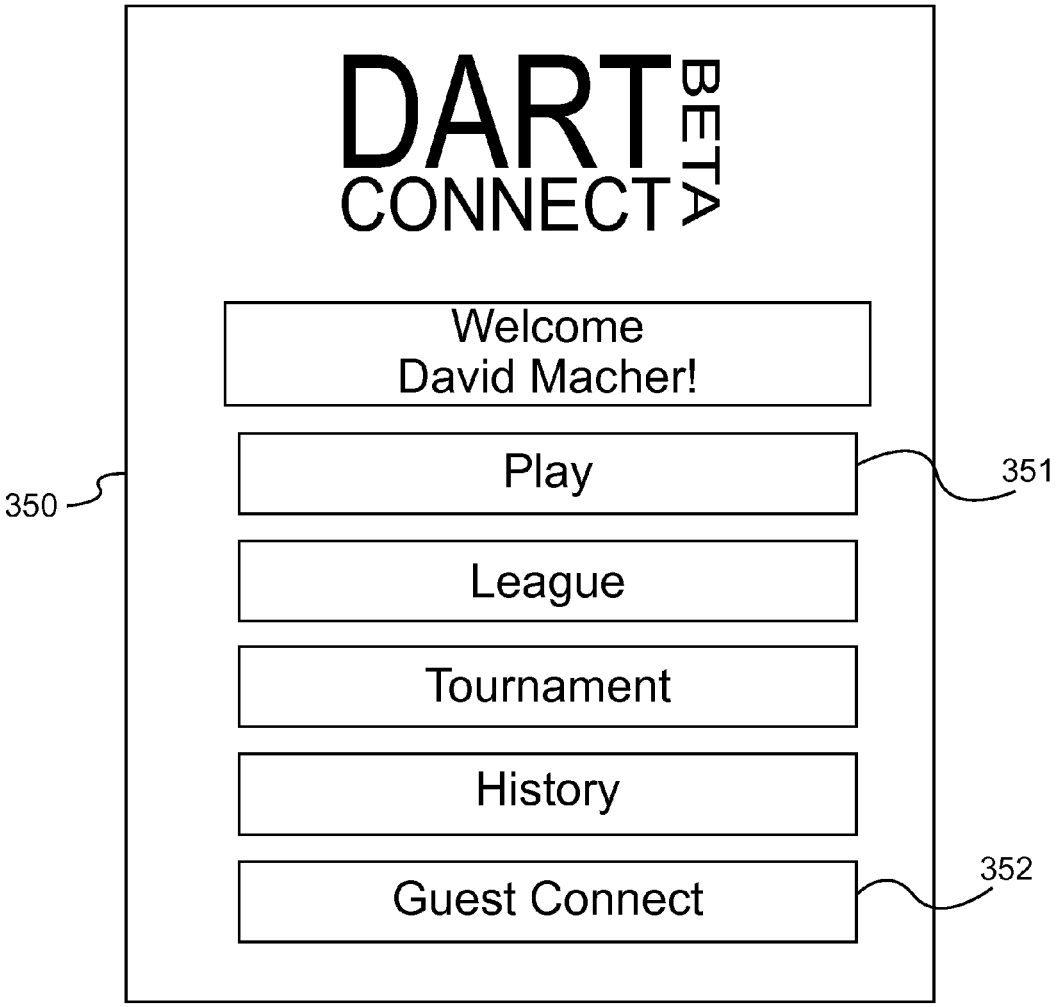
FIG. 3 depicts a launch screen according to one embodiment of the invention.
Figure 20:
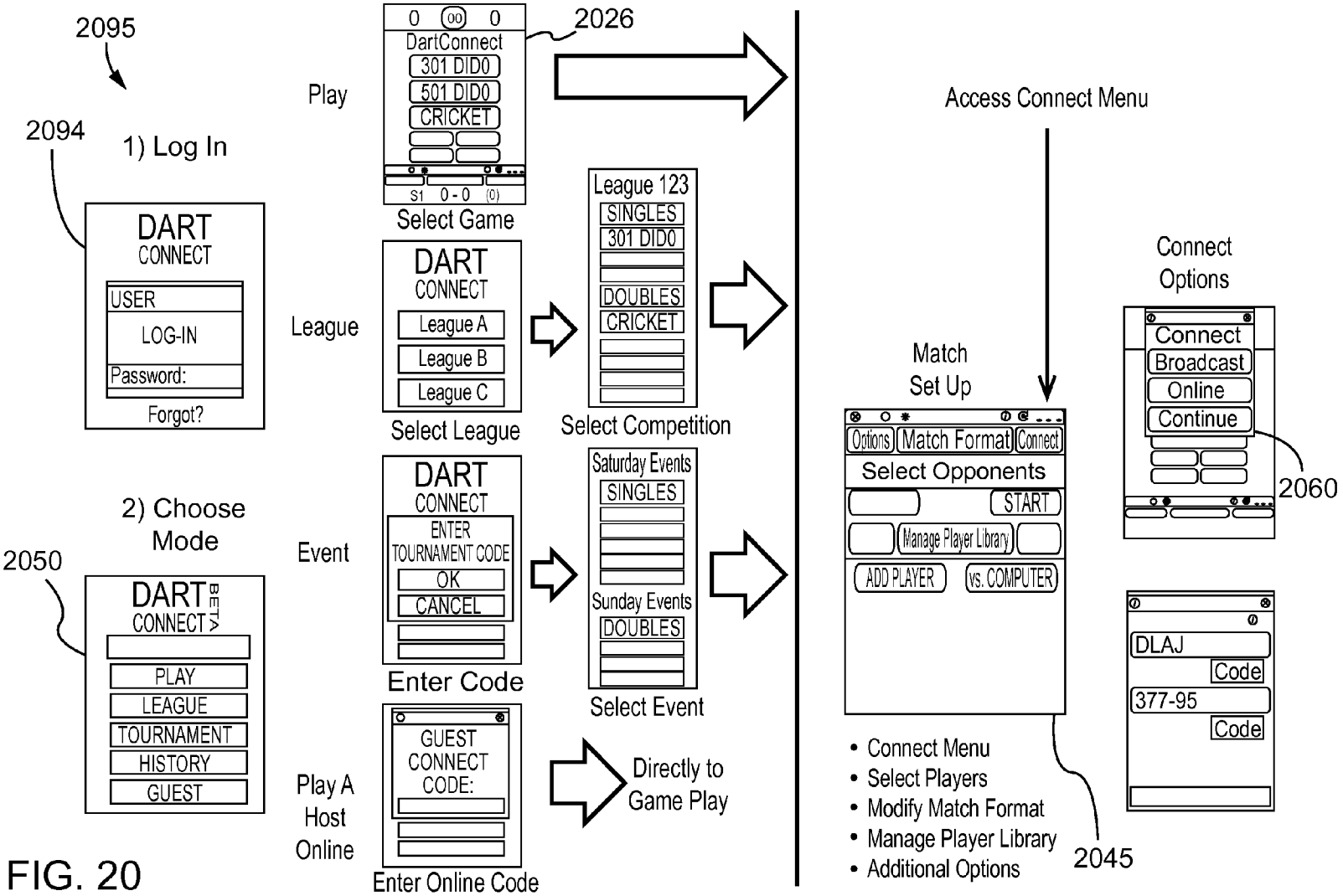
FIG. 20 depicts various user interface screens for a dart gaming system according to one embodiment of the invention.

Turning now to FIG. 20, seen is a system flow 2095 for enabling various system 100 features. For example, the log-in screen 2094 may be initially displayed to a user upon initiating the system 100 on any of the devices seen in FIG. 1. Through this screen, a user of the dart gaming system 100 may create an active member user profile in the system 100 and access the system 100 features. Each active member may have access to all matches & events (e.g., games, tournaments, etc.) in which they have participated. Data from the games that users have participated in may be populated within a membership account on the server 180, giving each user access to performance analysis. Such analysis may be used to provide a user rating and/or a user ranking and/or any other rating/ranking information or metrics which can be used to compare to the user to other members. It is also contemplated that the dart gaming system 100 may be used be a guest user 352, as seen in FIG. 3. A guest user may have the option of subscribing to the system 100 at any point and identifying the games they have previously participated in, populating their membership account with previous game data. Additionally, approved "outsiders" (e.g., though leagues, tournaments, etc.) can be given permission to have access to selected matches. As member games are stored over time, opportunities for virtual game play (i.e., database play) against themselves or others is available.

Figure 16:
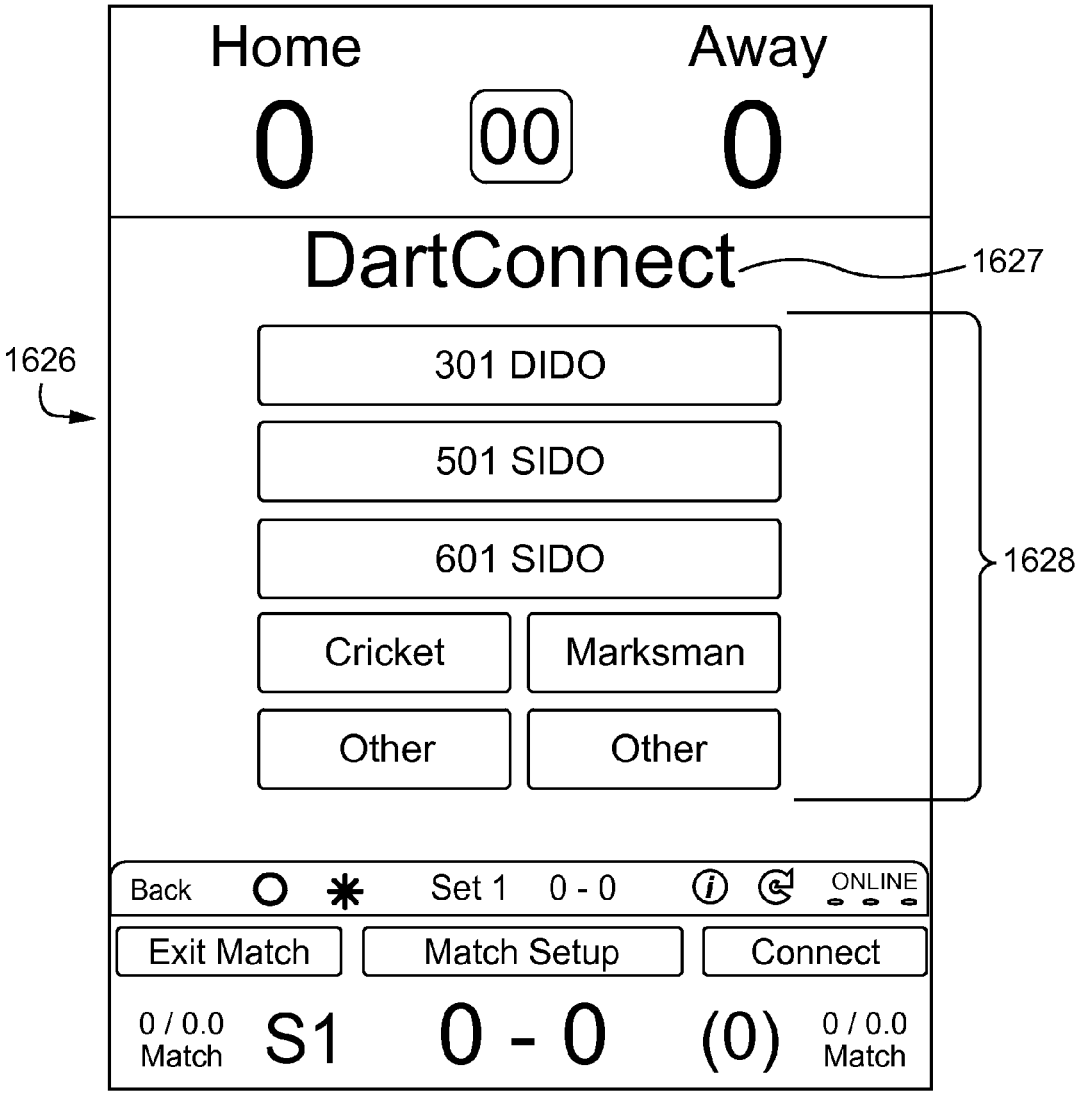
FIG. 16 depicts a menu screen according to one embodiment of the invention.
Figure 21:
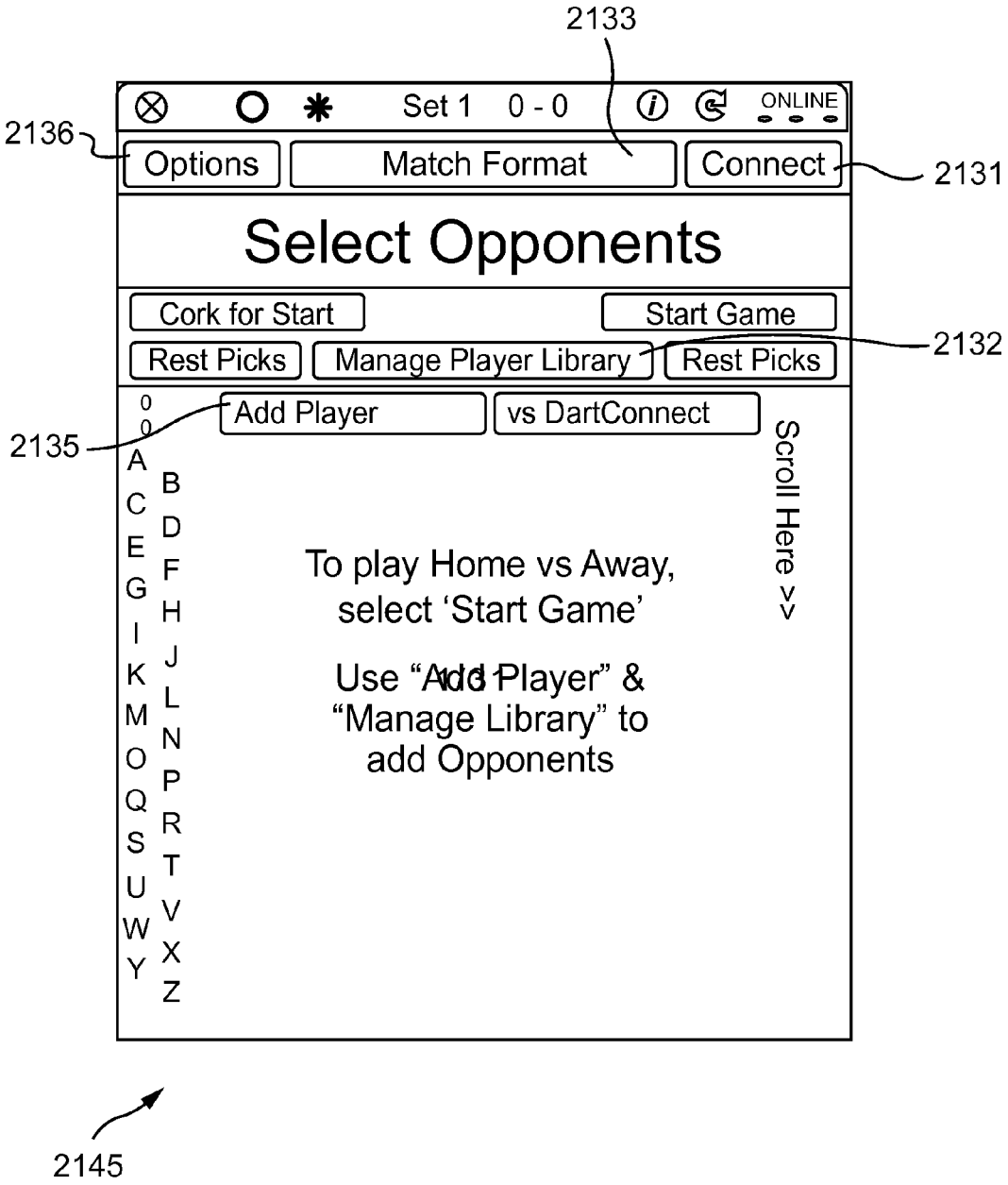
FIG. 21 depicts a match setup screen according to one embodiment of the invention.
Figure 22:
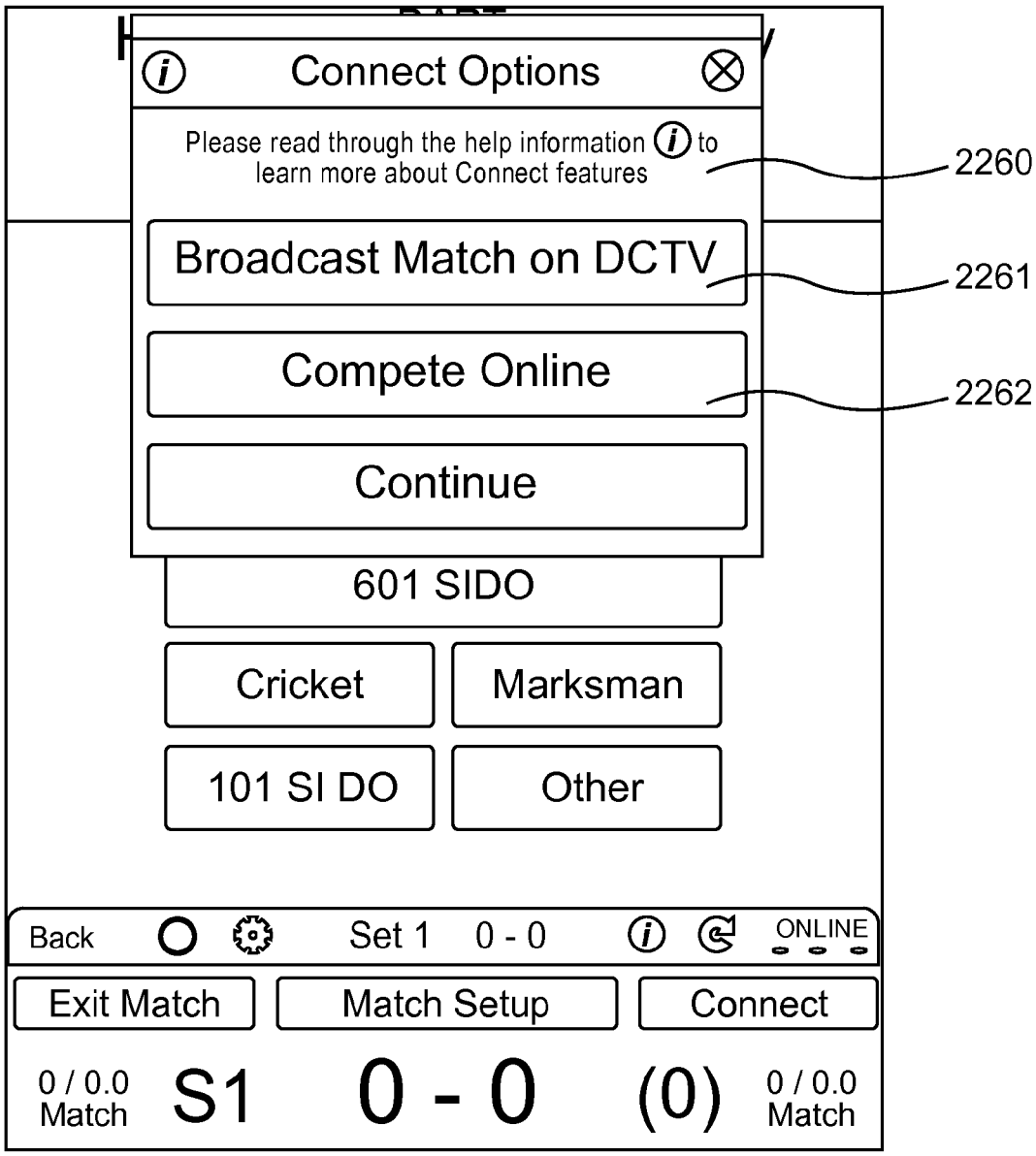
FIG. 22 depicts a connection options screen according to one embodiment of the invention.
Figure 23:
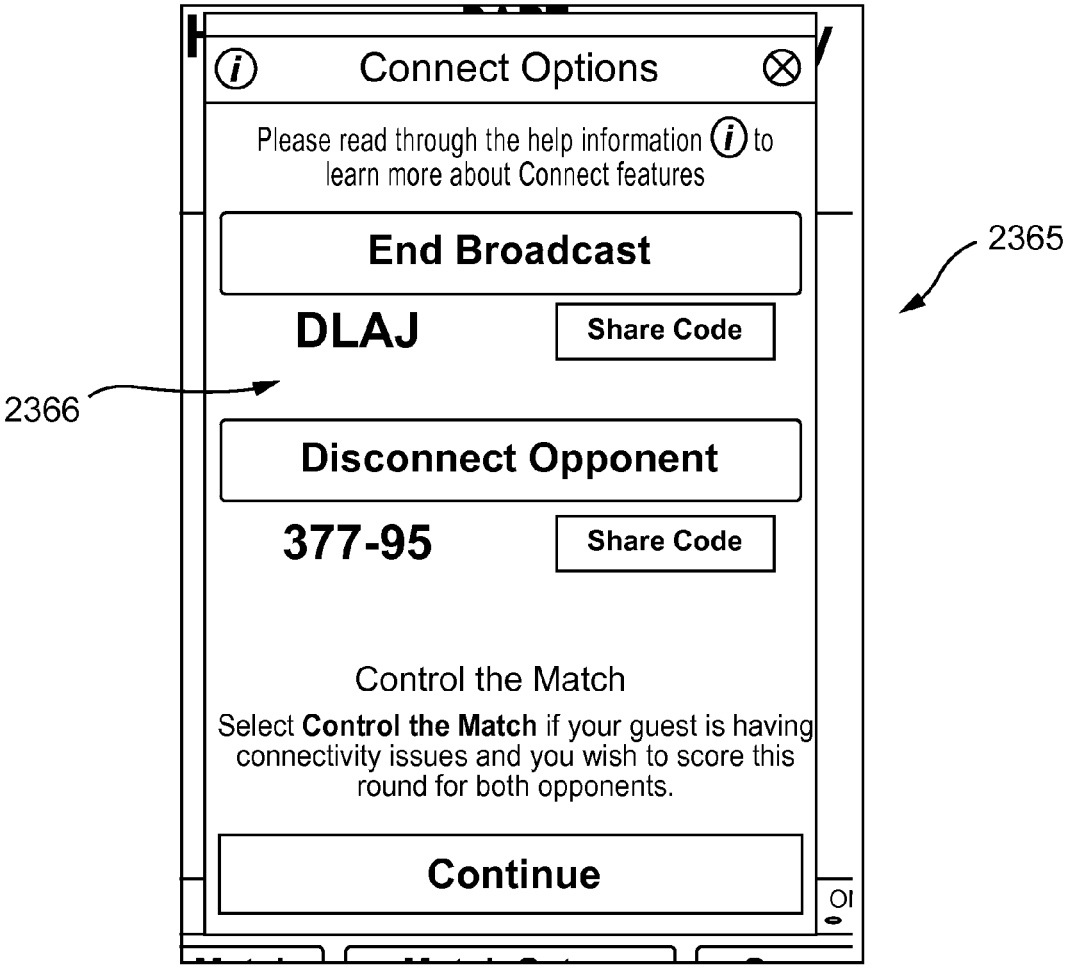
FIG. 23 depicts a second connection options screen according to one embodiment of the invention.

After entering a username/password into the log-in screen 2094, the launch screen 2050 may be displayed. The launch screen 350 is also seen in FIG. 3. Upon selecting the play 351 option in the launch screen 350, a menu 2026 screen, as also seen in FIG. 16 may be displayed. Seen in FIG. 16 are various dart game options 1628. A player may then select one of the dart game options 1628. Upon selecting one of the dart game options 1628, the match set up screen 2045 may be displayed, as seen in FIG. 20. As seen in FIG. 21, the match set up screen 2145 may comprise a connect 2131 option, manage player library 2132 option, match format 2133 option, add player 2134 option, and additional options 2136. The match format 2133 option modifies the no of games/sets/matches to be played. Players may be added through the add player 2134 and manage player library 2132 options. Upon selecting the players in the game, selecting the match format, and any additional options, the connect 2131 option may be selected. The connect 2131 option will display the first connection options screen 2060. As seen in FIG. 22, the connection options screen 2260 may provide a broadcast match option 2261 and an online option 2262. By selecting the broadcast match option 2261, a second connection options screen 2365 may be displayed, as seen in FIG. 23, which may provide a connection code 2366. The connection codes 2366, 266 described herein may also be referred to as a broadcast key, key, password, or any other similar term known in the art. The host may then share this connection code 266, 2366 with other users so that the other users may view the match.

Figure 2A:
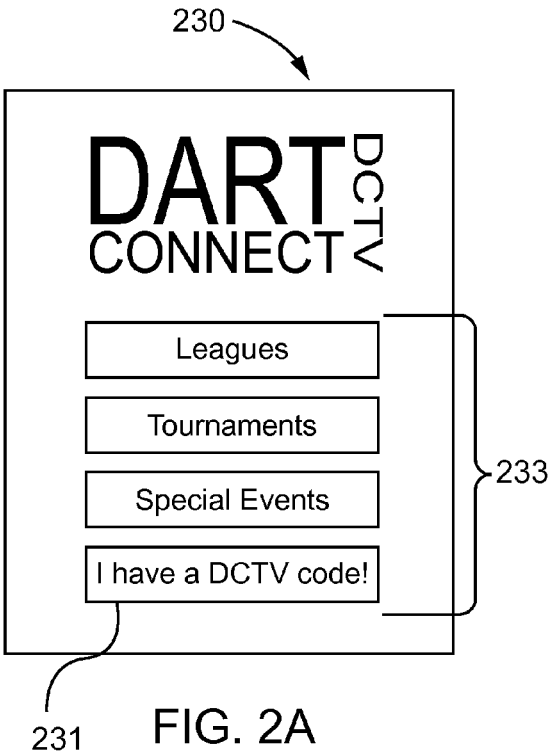
FIG. 2A depicts a first screen of a dart gaming system broadcasting feature according to one embodiment of the invention.
Figure 2B:
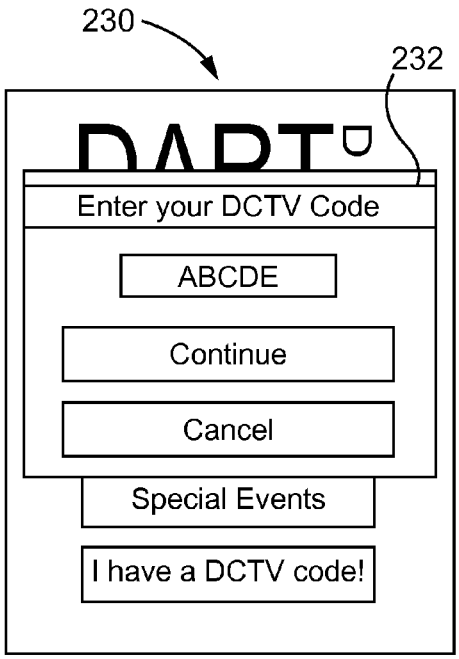
FIG. 2B depicts a code screen according to one embodiment of the invention.
Figure 2C:
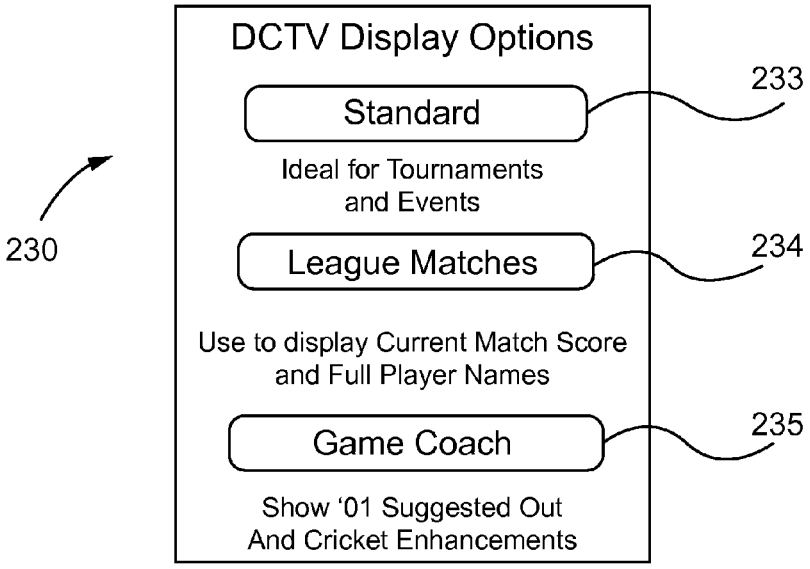
FIG. 2C depicts various dart game broadcasting options according to one embodiment of the invention.

Turning now to FIGS. 2A-2C, seen are examples of a dart gaming system broadcasting feature 230. The screen seen in FIG. 2A may comprise a code option 231, which, when selected, may display the code screen 232 seen in FIG. 2B. Entering the connection code 2366 into this screen will enable the spectator to receive the scoring interface from the scoreboard 112 or other on-site solution 110 device, via the server 180 in at least one embodiment. Selecting one of the link options 233 may provide a link to public matches to view. For example, the online option 2262 seen in FIG. 22 may create a publicly-accessible link on a publicly-available webpage. This link may have the ability to "broadcast" their match play on the internet—viewable with any browser, when the link is accessed. For public broadcasts, interested parties may also be directed to a listing on a web page that provides a link which gives the spectator instant access to the game/match/tournament. The broadcasting application may comprise a feature which takes advantage of landscape display environments. One dart gaming system 100 may comprise an HTML5 (or any other program known in the art) program capable of running on any computing device comprising an internet browser such as, but not limited to, Internet Explorer®, Mozilla®, or Google Chrome®. As seen in FIG. 2C, a standard viewing option 233, league viewing option 234, and/or game coach viewing option 235 may be provided to a spectator after either entering the code, as seen in FIG. **2*b*, or accessing the link through the link options 233. The standard viewing option 233 may display a scoring interface and current averages for each player. The league viewing option 234 may also provide a match score and full name listing of the players, while the game coach option 235 may also enable the viewers to receive game tips and strategies. The players may also receive these tips and strategies or may choose not to receive them through the user settings 1919, as seen in FIG. 19**.

The system 100 may comprise an audio and/or video component (e.g., live two-way audio and video) to any dart game initiated on the dart gaming system. Such audio/video may be provided through the dart gaming system using any 3$^{rd}$-party VOIP or video-streaming service. It is contemplated that the video component may be utilized to support the scoring in the system 100. For example, if a score is contested, a video replay may be used to determine whether the entered score was accurate. Alternatively, the video feed may be automatically utilized by the system 100 to record scores in the system.

Two players, geographically separated, can play a match through the dart gaming system 100 by connecting through the server 180. The server 180 will also distribute the user interface on the scoreboard 112 device to the spectators, as well as record and save all player, team, league, and tournament score data for each throw in every game played on the system 100. To enable play between two geographically remote players, a match host may provide the broadcast key to an opponent that the opponent uses to join the host in the system 100. The game may proceed on two devices, giving each player an opportunity to score their own turn. The server 180 ensures that each player's scoreboard 112 is updated with the same data in real-time, regardless of which player enters the data. The host may also have the option of broadcasting this game to spectators at the same time through the broadcasting feature seen in FIG. 2 or described in relation to FIGS. 22 and 23.

One embodiment of the system 100 may comprise using data generated by the system 100 to create an interactive community between users of the system. In such a community, statistics for players may be created for comparison within and amongst the community. Such statistics and reports may be seen in FIGS. 24 and 25. Furthermore, rankings may be created among friends and/or competitors, players may be allowed to share achievements amongst other users and the system may enable players to play another player's games from a system database. For example, users have the ability to practice against "real games" that were previously played by users of the system 100 (themselves or others). This feature is provided by the system 100 keeping a historical log of all games played by users of the system. In one such feature, the system 100 may select a random recent game previously played by a user. Such a game may have been won by the user. The system 100 then reproduces each turn the player had, while the challenging player throws live darts and records his turns as he normally would in the system 100. The result is a similar to playing against a computer opponent, but instead the user is alternating turns with a historical game.

After a match ends, the dart gaming system 100 may generate a communication such as, but not limited to, an email with a link which accesses the reports seen in FIGS. 24 and 25, or any other report. One such communication 2626 is seen in FIG. 26. An example of statistics 2727 created with the system is shown in FIG. 27. These reports and/or statistics may comprise information for all match participants and may comprise (a) an event description, (b) a match analysis, (c) a match recap, (d) the recognition of an exceptional player and any team accomplishments, and (e) any other news and/or offers for the user. In one embodiment, a user may have the ability to combine match data from separate devices or separate matches into one event summary that the user can review afterwards. For multi-device summaries, a user may request an "event key" and then distribute the key to other members of the match who may then flag their matches on their devices with this identifier. For a multi-match summary, a user can create an on-going "open" event. Anytime a user wants to include a specific match, they would simply reuse the assigned key.

The dart gaming system 100 is adapted to reduce new user anxiety. For example, any required math skills for scoring are eliminated as the system 100 accommodates all level of users. This increases the scoring accuracy, using redundant features to mitigate the typical mistakes associated with electronic interfaces, including user miss-keys, score keeper errors and unresponsive devices. Furthermore, the system 100 uses traditional scoring methods to replicate the "chalk board" scoring experience, enabling easier, faster and more accurate match scoring, allowing the players and score keepers to focus on the game itself.

Figure 4:
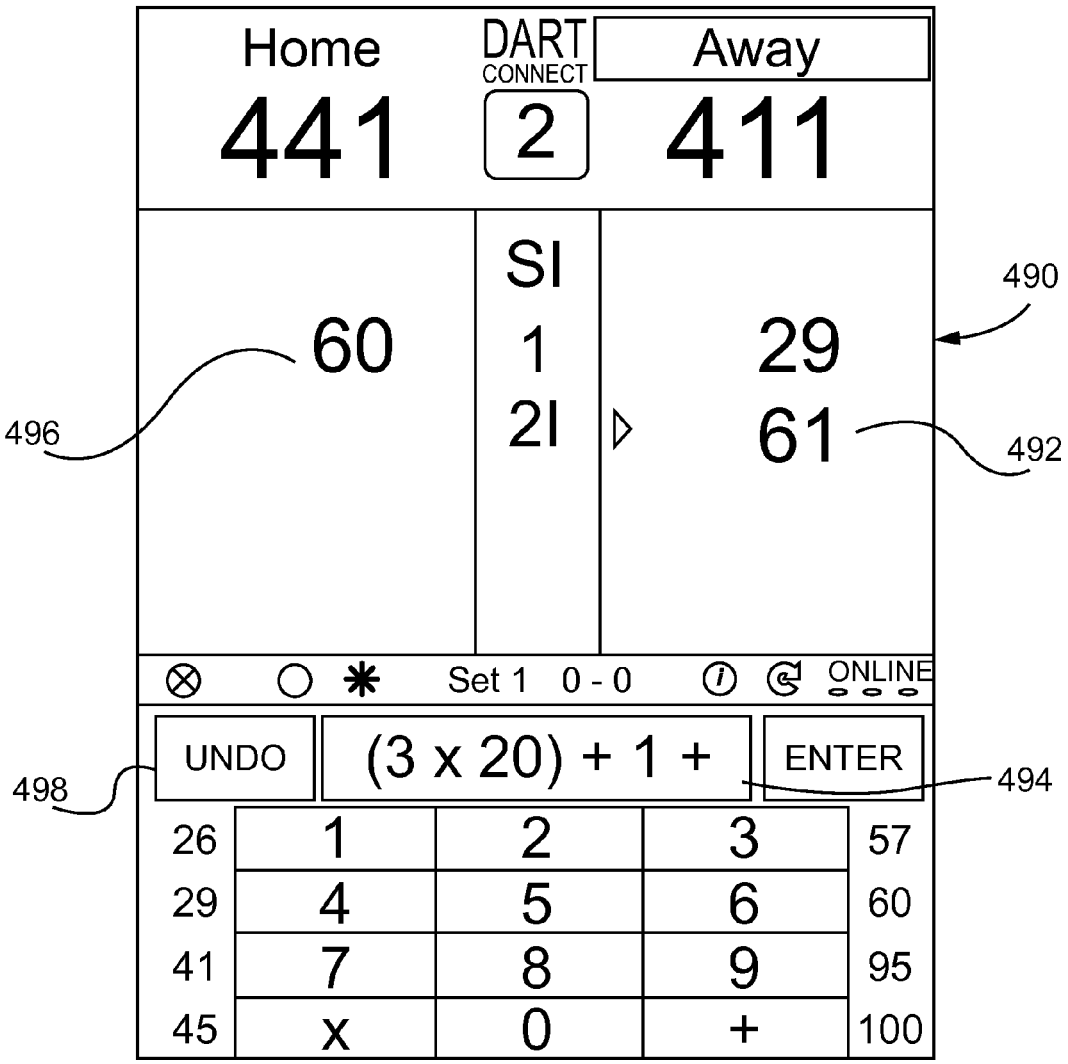
FIG. 4 depicts an '01 scoring interface according to one embodiment of the invention.

Turning now to FIG. 4, seen is one example of a scoring screen 490 for an '01 dart game. This may be the scoring screen 490 displayed on the scoring device 112 and adapted to receive scoring information, and may be broadcast to the off-site devices 120. Various challenges of scoring a dart match are addressed in such a screen 490. For example, the current turn 492 in the match (i.e., which identifies the user that needs to input a score for each round) is highlighted in s color different from the previously-entered scores in an audit trail 196 to make it clear to all what is being scored. Additionally, a score window 494 displays and stores for later review (upon accessing a score in the audit trail 496) what is actually being keyed by the user though an integrated calculator functionality within the keypad, which assists with math processing. Through the audit trail 496 of recent turns, players, score keepers and spectators may quickly and easily review the accuracy of entered prior turn scores. Also provided is an easy edit "UNDO" button 498 to erase the current entry. The UNDO button transforms into a BACK button when there are no entries in the score window 494 and the "BACK" button highlights the prior turn in the audit trail 496 to show parties what was keyed by the user in the score window 494 along with the resulting score in the audit trail 496.

Figure 5A:
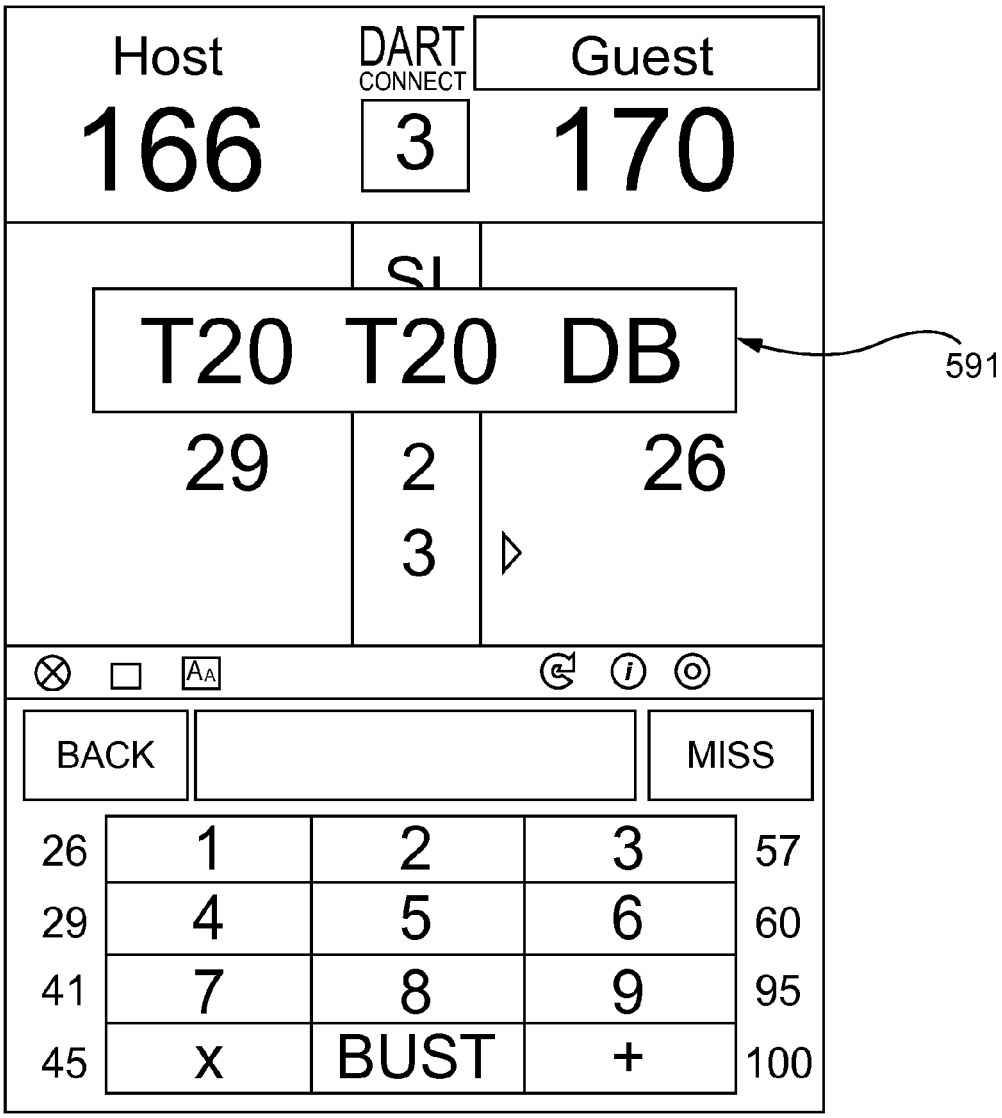
FIG. 5A depicts a training tool according to one embodiment of the invention.
Figure 5B:
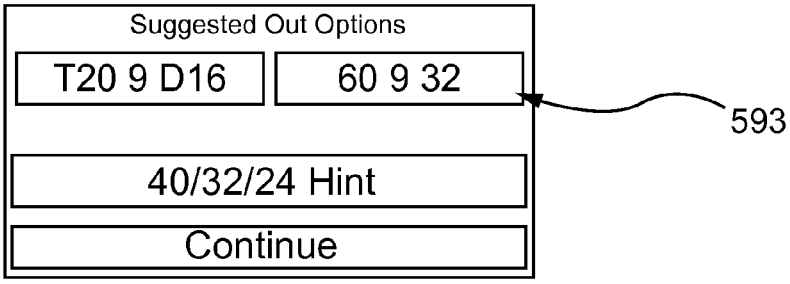
FIG. 5B depicts suggested out options in a notification according to one embodiment of the invention.

Seen in FIG. 5A is one example of a training tool to assist in determining the optimum targets to win an '01 game. As seen, as assist notification 591 may display what score the "Guest" player would need to obtain with each dart in a 3-dart throw in order to obtain a score of "170". These scores are shown as "T20," "T20," and "DB," which means that the first dart throw lands in a triple-20 score portion of the dartboard, the second dart throw also lands on a triple-20 score portion of the dartboard, and the third dart throw lands in the double bull's-eye. With each triple-20 score providing sixty points and the double bulls-eye providing 50 points, this point total would be 60+60+50, or 170 points. Seen in FIG. 5B are alternative or additional outputs 593 that may be shown in the notification 591. For example, instead of the alpha-numeric display shown in FIG. 5A, only a numerical display may be used (though the display in FIG. 5B does not add up to 170, so this is for a different game/user). The alternative output 593 may also provide a "hint" which provides a mathematical solution for reaching the optimum targets.

Figure 6:
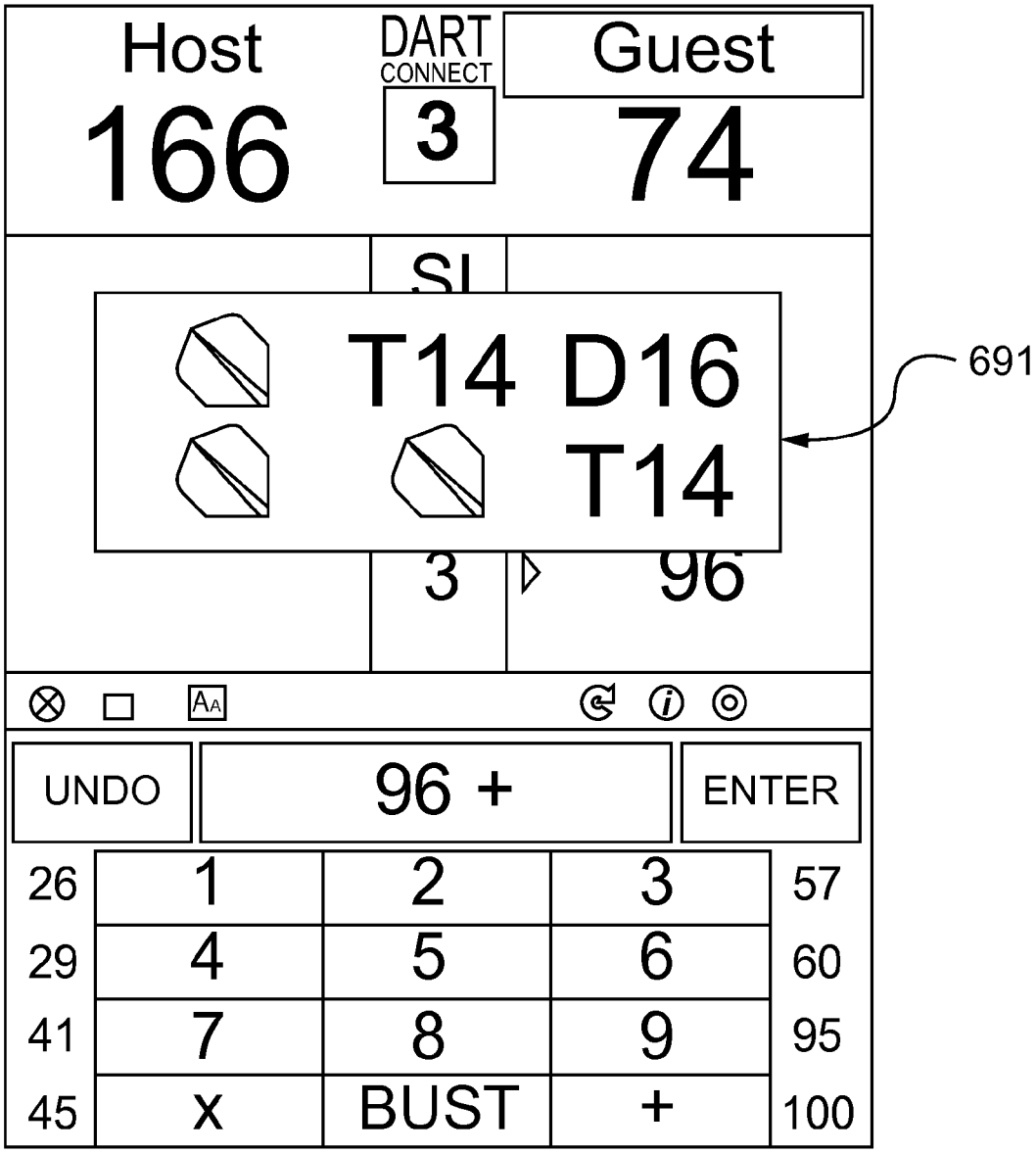
FIG. 6 depicts an assist notification according to one embodiment of the invention.

In one embodiment, suggested outs for an '01 match may be broadcast to one or more connected devices. The devices adapted to receive the suggested outs may be set up through the options 1919, as seen in FIG. 19. The suggested outs may be based on the current game score. For example, the system may utilize a network connection between the scoreboard 112, server 180, and remote devices to broadcast coaching tips to user device in real time or to assist a player with the current game. Such messages may be only displayed at an identified user device (e.g. the "host" device) and may not be displayed on a shared score board, which may also be referred to herein as a primary score board. In addition to the required out strategy for '01 games, additional examples of this feature comprise providing an additional number of point bullseyes required to win a game of Cricket. Alternatively, strategy tips may be provided to user for any game. As stated, such information may only be broadcast to a particular user, who may request it, which preserves the presentation of the game state on the primary device. Turning now to FIG. 6, seen is an assist notification 691 comprising a suggested out option provided to a user that has thrown a partial turn, but still has one or two darts to throw to complete his round. In such an instance, the user may click, for example, the "+" sign in the image below. This may display one or more suggested targets for each throw.

Figure 7:
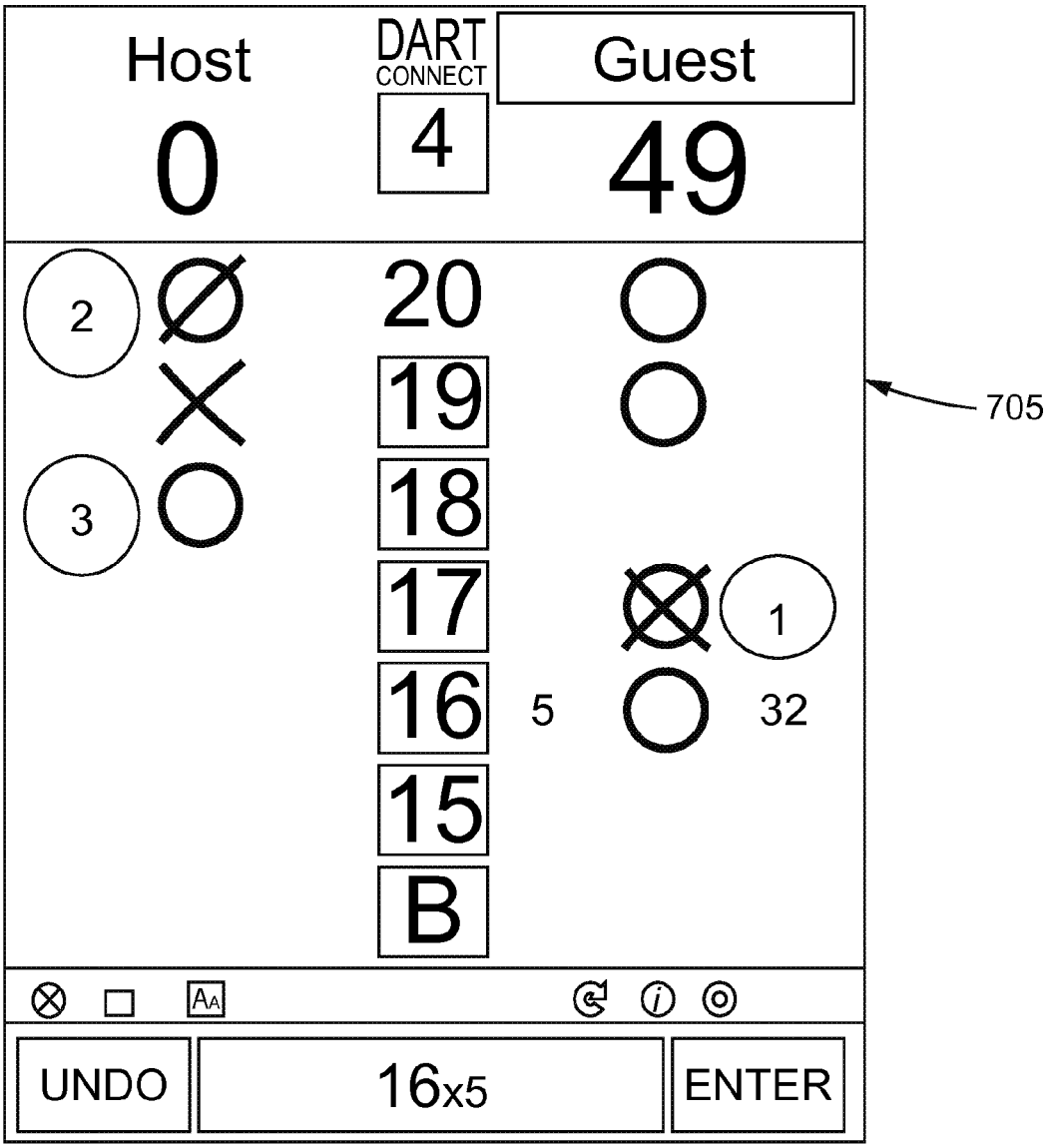
FIG. 7 depicts a cricket scoreboard according to one embodiment of the invention.

Turning now to FIG. 7, seen is a cricket scoreboard 705. As seen, the cricket scoreboard 705 uses a "I/" or "slash," an "x," and an "O" identify a single hit in a single-point throw, a double-point hit in a single throw, and a triple-point hit in a single throw, respectively, on that number. The cricket scoreboard 705 also displays the exact throws which lead to three hits "O" mark. For example, the "1" bubble shows two slashes (an "x") and a circle. This is used for a user that hit the target over three separate turns. The "2" bubble displays a single-slash and a circle, evidencing that a player hit that target once in a prior turn (single slash) then connected again twice in a subsequent turn, with the additional two connections shown by the circle (a double target score portion of the mark was hit, for example). If the player hits a valid target three times in the same turn, then the closed target will be represented by a circle only, as seen in bubble "3."

Figure 8:
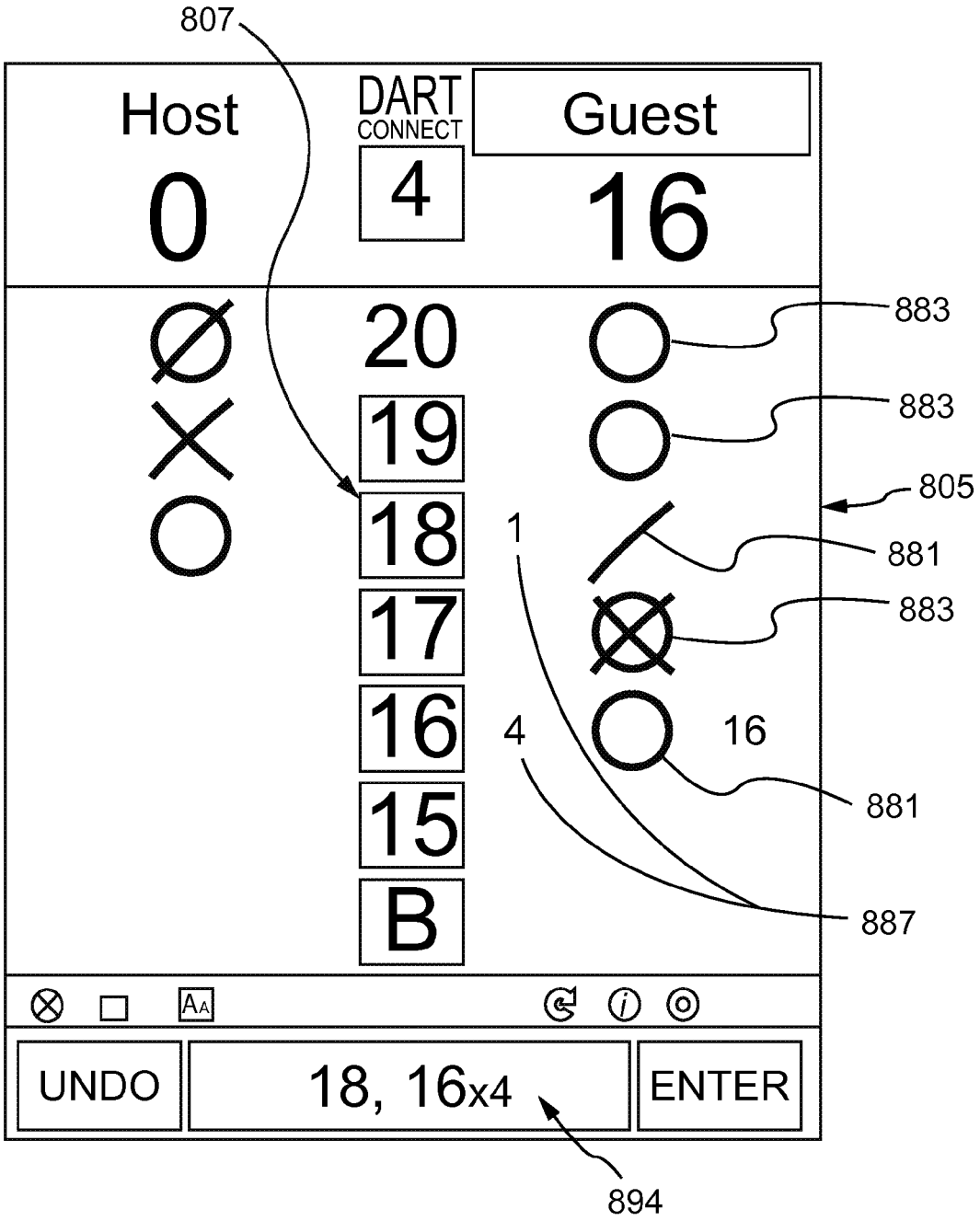
FIG. 8 depicts a cricket scoreboard according to one embodiment of the invention.

Turning now to FIG. 8, seen is one example of a cricket scoreboard 805 showing the redundancy in recording scores to ensure accuracy. For example, the current turn target "hits" 881 may be highlighted in a first color to differentiate current turn scores (marks) from pre-exiting scores 883 in a second color. Additional redundancy may be provided by displaying the number 887 of times a user has tapped the target button 807 for that target (tapping the target button 807 may be how a user identifies that the target was hit by a dart, thereby recording a score for that target). This number 887 is shown in FIG. 8 as the "1" & "4" next to the "18" and "16" targets, respectively. Furthermore, any target hit that results in points for the turn, is reflected in the margin for that target (note the "16" points) in the margin for the "16" target. Redundancy is further provided by listing all target entries for the turn in the score window 894 (note the "18, 16×4 times"). If a target has been "closed" by both players in prior turns (i.e., no further points may be obtained for either player for that target/number), the target may become visibly inactive (e.g., the "20" target button may comprise a darker color).

Figure 9:
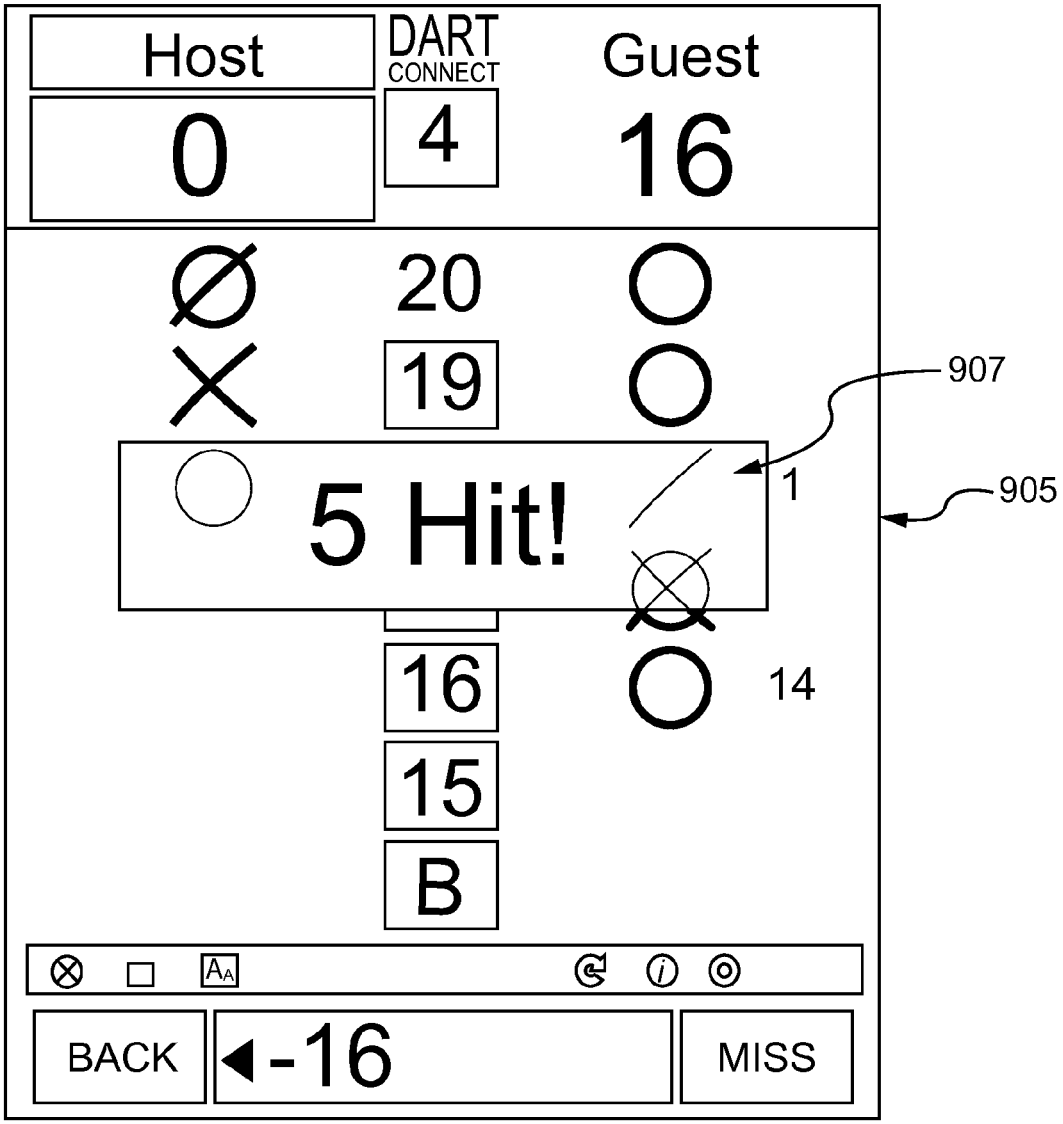
FIG. 9 depicts a cricket scoreboard according to one embodiment of the invention.

Turning now to FIG. 9, seen is what may happen after a turn has been submitted by pressing the "enter" button, as seen in FIG. 8. In one embodiment, the cricket scoreboard 905 may display what targets were scored on the previous turn (note the "1" and "4" in the margin). Exceptional or high-count turns may generate a pop-up fade-out message 907 calling out the nature of the accomplishment and to ensure the correct score was recorded.

Figure 10:
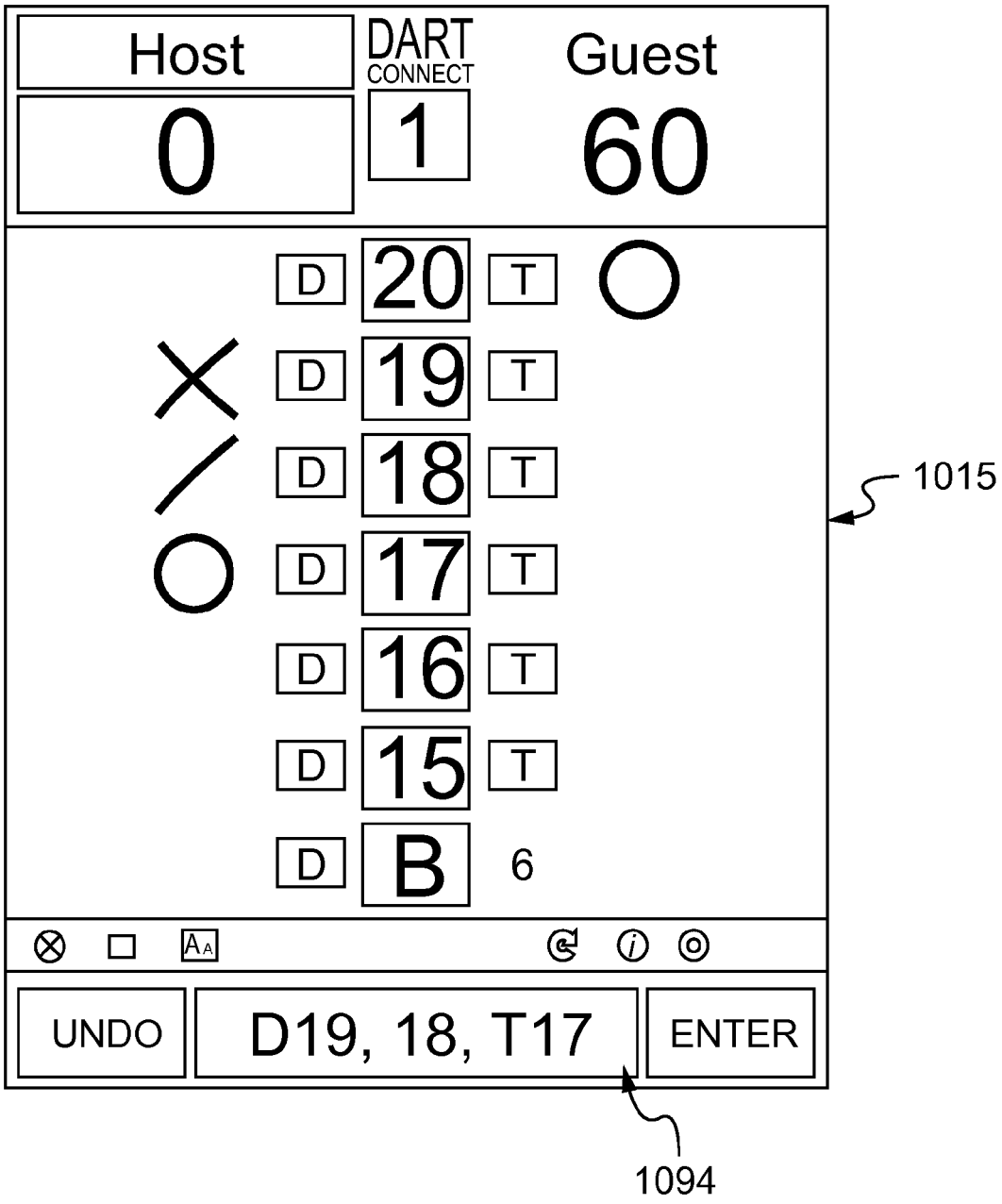
FIG. 10 depicts a marksman cricket scoreboard according to one embodiment of the invention.

Seen in FIG. 10 is a marksman cricket scoreboard 1015. The marksman cricket scoreboard 1015 comprises a 3-button ("D" button, target button, "T" button) approach to scoring cricket. The "D" button is for registering a double point score of the proximal Target Number and the "T" button is for registering a triple point score for the proximal Target Number amount. The Target Number registers a single target number score. This scoreboard 1015 may improve accuracy as the user avoids having to count and tap the Target Number multiple times for each hit that is a double or a triple. Furthermore, the score window 1094 displays exactly what was keyed. Speed of scoring may be increased since the maximum key stokes per turn is 3, as opposed to up to 9 with the approach seen, for example, in FIG. 9. Unique statistics may also be provided with the marksman cricket scoreboard 1015. For example, since the user informs the scoreboard 1015 what segment (single/double/triple) of each target the each dart actually hits (as opposed to the "roll up" scoring method associated with the standard FIG. 9 methods), specific statistics could be generated for this information, including, but not limited to, total missed darts (not just missed turns), total number of triple segments, doubles segments, single segments acquired, and targets hit but not scored due to opponent's existing position in the game. Such information may allow the user to know how many darts scored their full potential value or the average of potential value for each dart thrown.

Figure 11A:
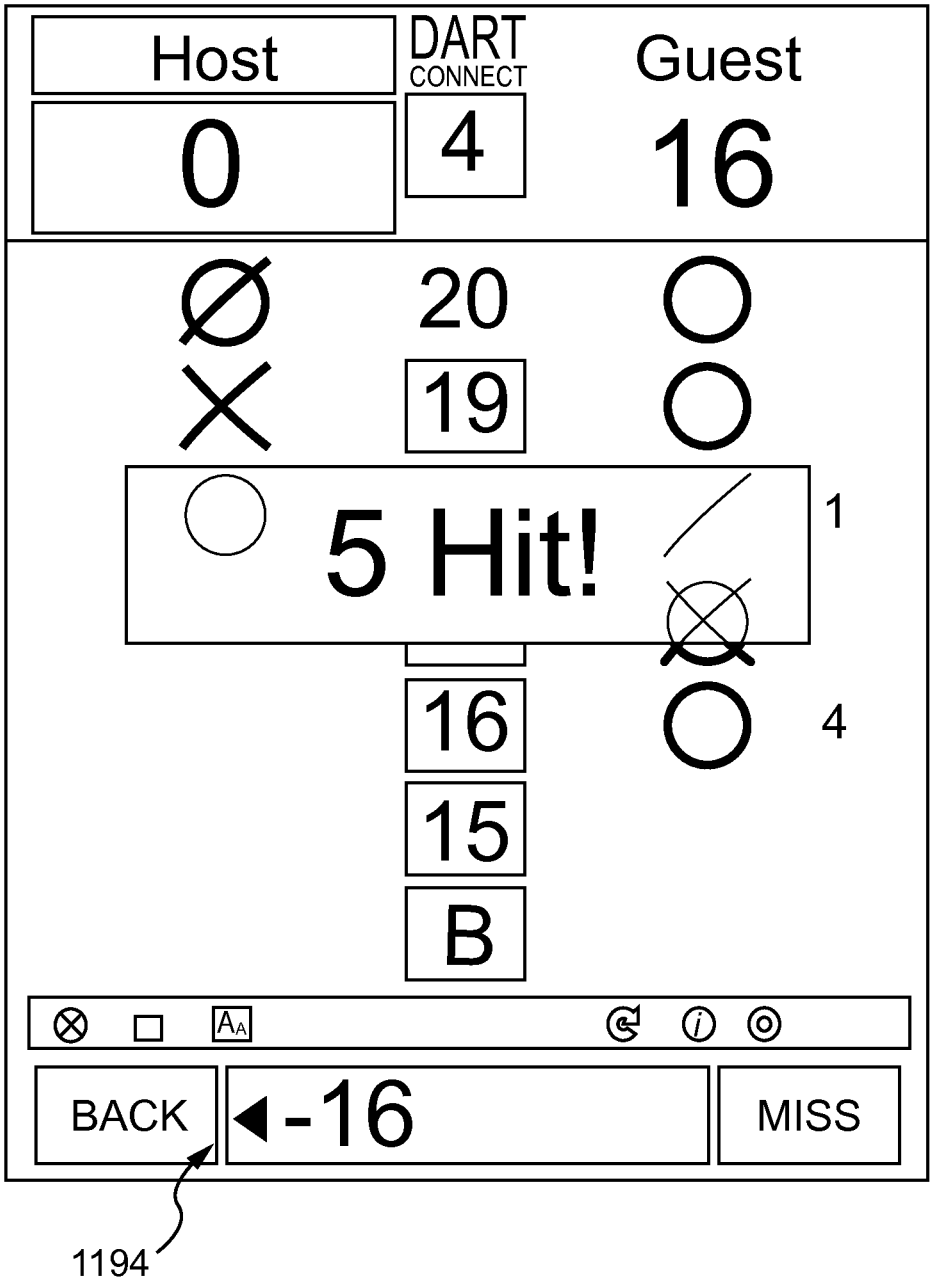
FIG. 11A depicts a hint that may be provided during cricket play scoreboard according to one embodiment of the invention.
Figure 11B:
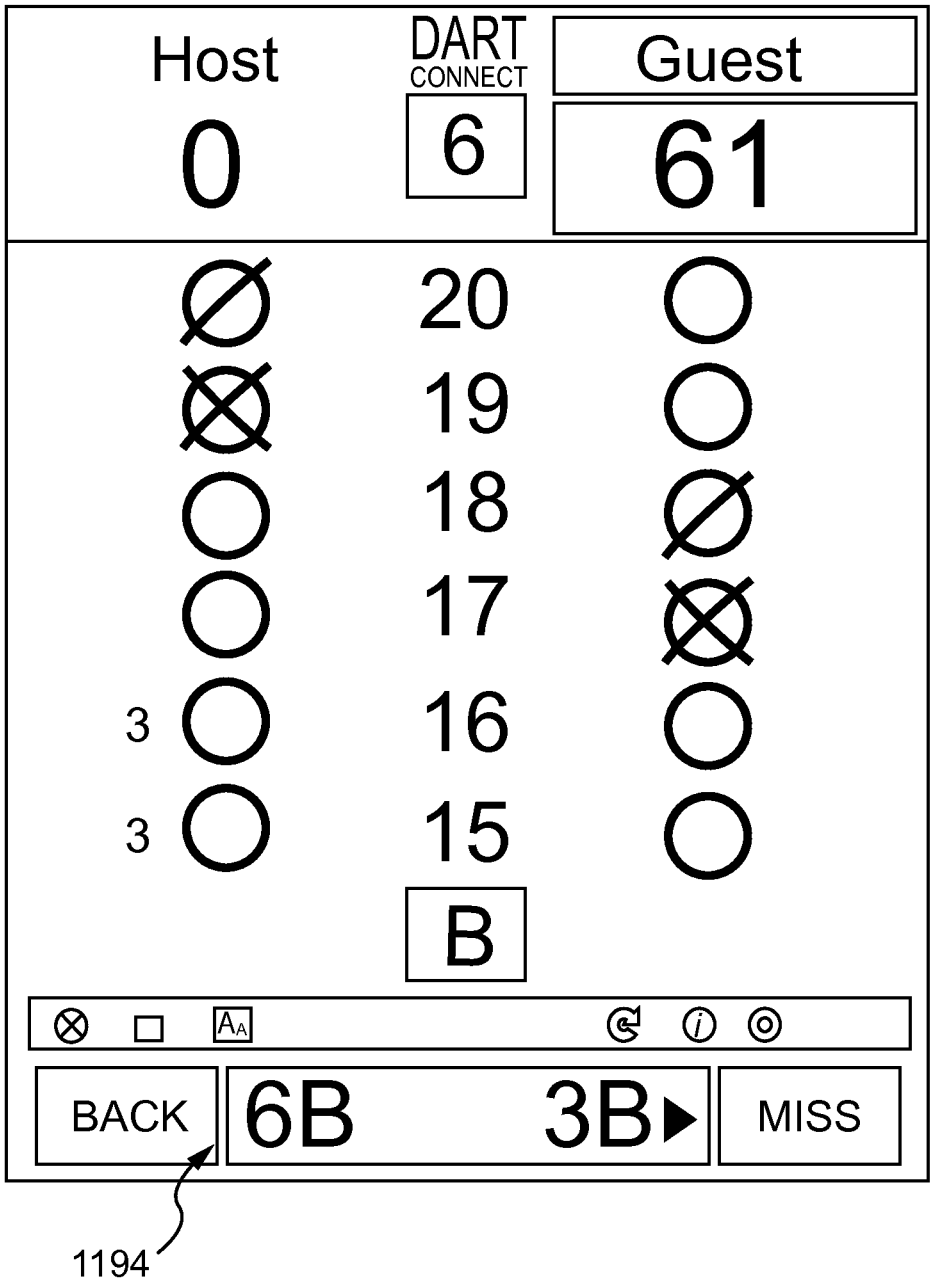
FIG. 11B depicts a hint that may be provided during cricket play scoreboard according to one embodiment of the invention.

Turning now to FIGS. 11A and 11B, seen are hints that may be provided during cricket play. In FIG. 11A the hint is shown in the score window 1194, informing the Host player that the player is behind by 16 points. In FIG. 11B, both players have closed out all their respective targets except the bulls-eye target ("B"). Rather than forcing each user to calculate the math value of the number of target bulls that are required for that player to win the game, the system calculates how many bull targets each player needs to hit to win the game. As seen in the score window 1194, the host player needs to acquire six Bull targets and the guest player requires only three bull targets to win.

Figure 12:
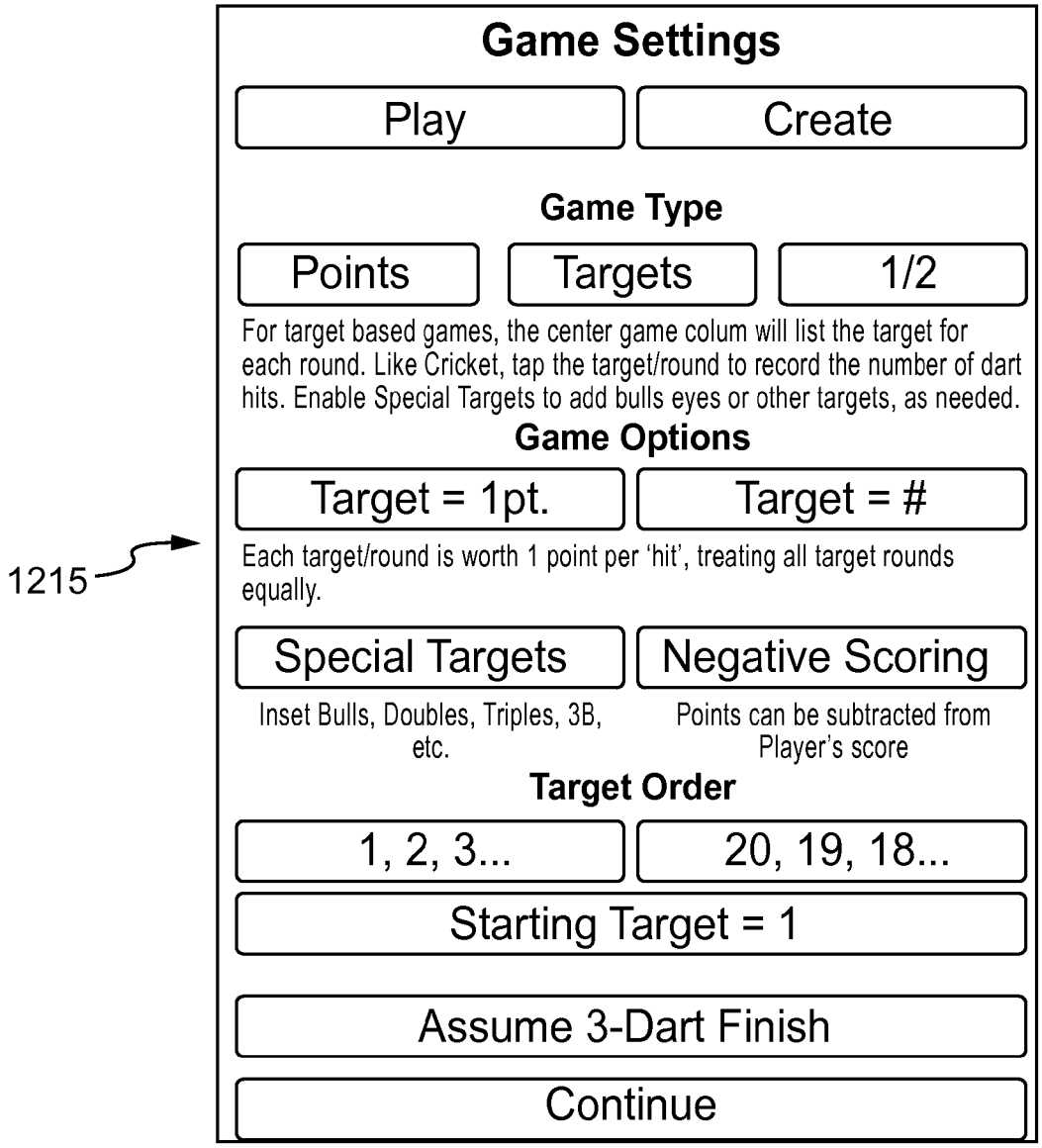
FIG. 12 depicts a game and practice generation screen scoreboard according to one embodiment of the invention.
Figure 12A:
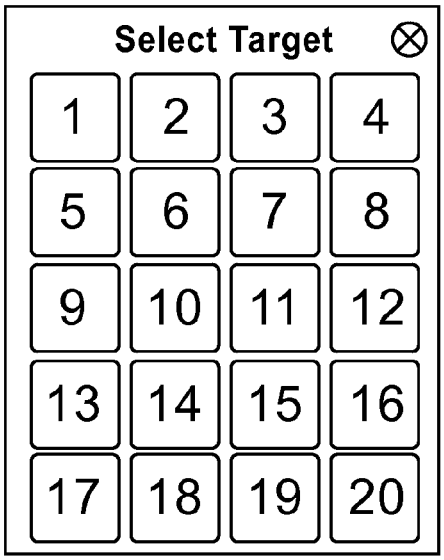
FIG. 12A depicts a game and practice generation screen scoreboard according to one embodiment of the invention.
Figure 12B:
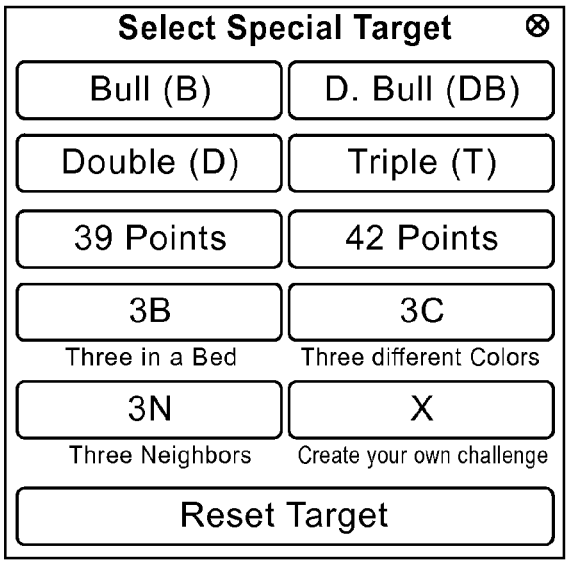
FIG. 12B depicts a game and practice generation screen scoreboard according to one embodiment of the invention.

Turning now to FIG. 12, seen is a game and practice generation screen 1215. The menu system seen in FIG. 12 enables a user to design a game or practice routine according to their personal preferences and rules. Games and routines fall into 3 general categories: (i) point-style games, (ii) half-it style games, and (iii) target-style games. Games & routines can be further customized with options including (a) Enable Negative scoring, (b) Assuming 3 Dart Finish, (c) Determining Target values, (d) Enabling inclusion of Special targets, and (e) Determining the Starting target. Created games and routines can be saved for future use. FIGS. 12A and 12B may also be used in creating the new games/practice routines.

Figure 13:
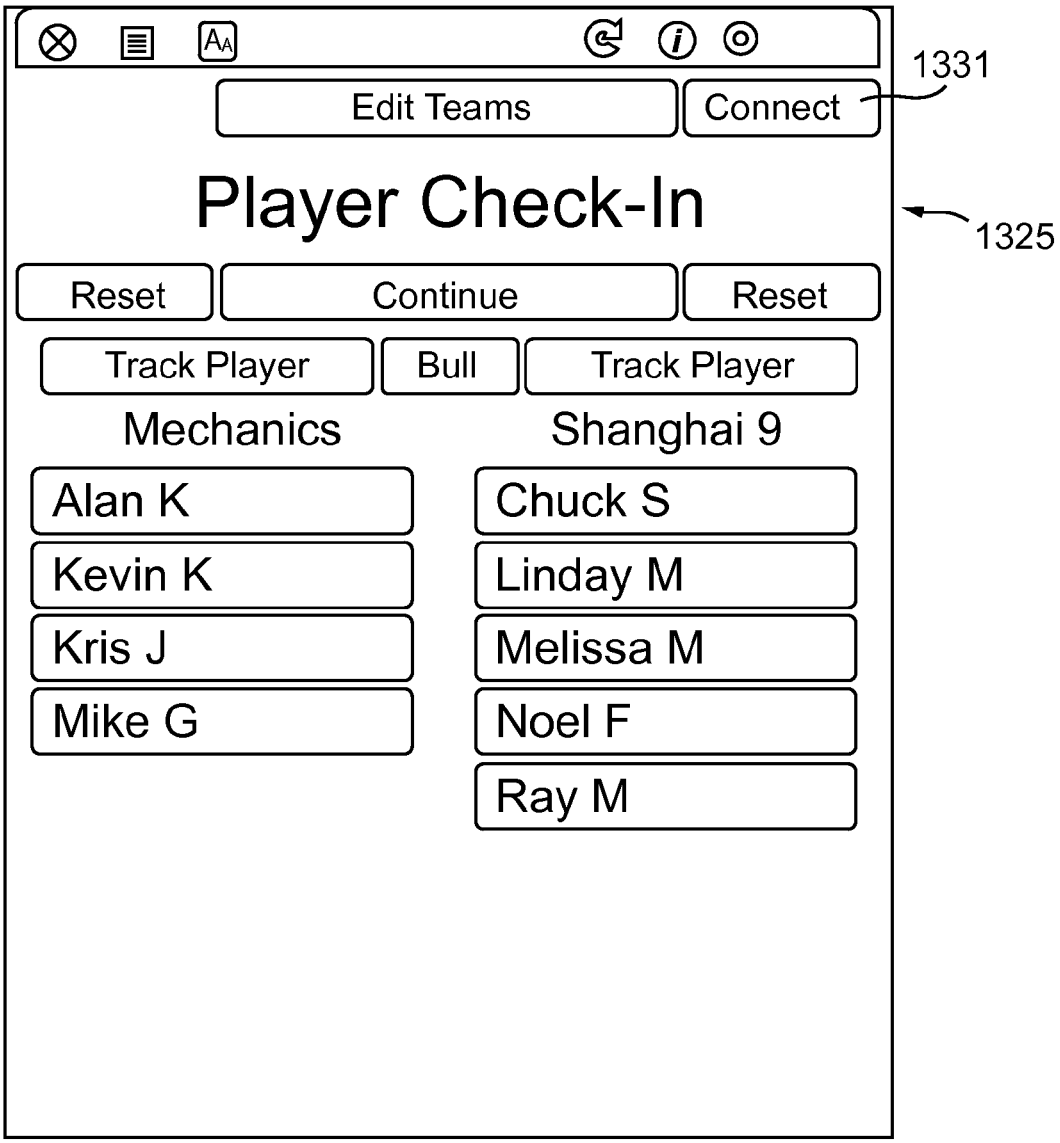
FIG. 13 depicts a Group/Team screen according to one embodiment of the invention.
Figure 14:
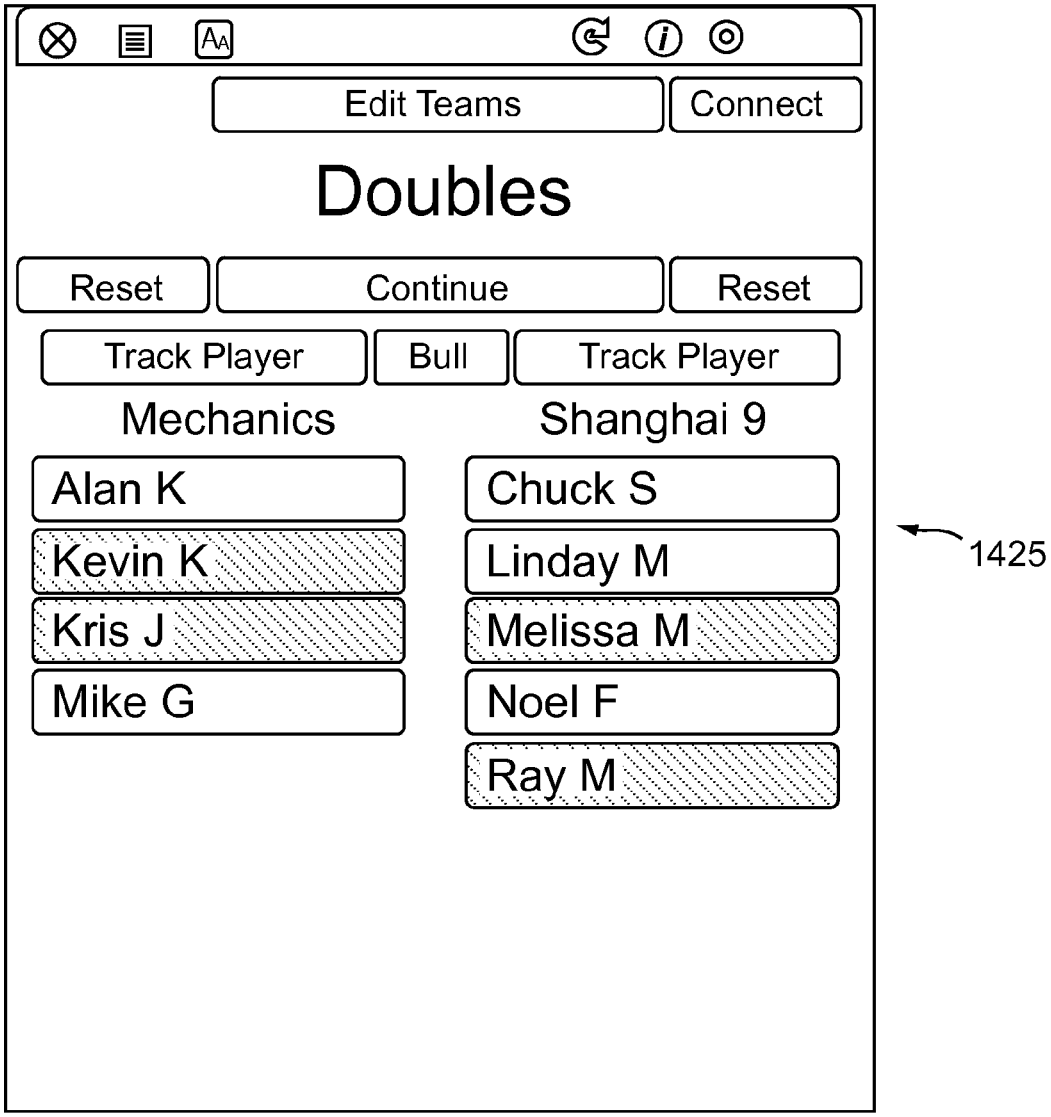
FIG. 14 depicts a Group/Team screen according to one embodiment of the invention.

Turning now to FIG. 13, seen is an example of a Group/Team screen 1325. The Group/Team screen 1325 provides the ability to easily run competing teams of 4-12 players (may have different number of player per team) in a multi-game match while also tracking their personal performance and updating their performance statistics in real-time without interfering with match play. The Group/Team screen 1325 sets up group play by eliminating traditional menus & software wizards. As players are selected for each game through the Edit Teams button, the screen 1325 will automatically change from singles to doubles, triples, etc. As seen in FIG. 13, one Group/Team screen 1325 may be adapted to select two teams for a match and display the team rosters. After selecting the players for each team, a match may be initiated by selecting the connect 1331 button. The connect button displayed in FIG. 13 comprises a similar functionality as the connect 2131 option in FIG. 21 and as seen and/or described elsewhere herein. The system 100 may record each player's turn in the order it occurred and automatically start a new set whenever there is a change in the player line-up. Through this feature, the system 100 is enabled to create a match summary populated with player names and their throwing order, while tracking individual performance—even when participating in group play (Doubles, Triples, Quadruples). The system 100 may inform the players to "Check In" before the next game commences As seen in the Group/Team screen 1425 in FIG. 14, the players or a third-party score keeper may select the opponents from each team, with the system 100 automatically determining what type of group play is occurring (Doubles in the FIG. 14 case). The system 100 may accommodate team number mismatches such as, but not limited to, Singles vs. Doubles, by automatically recording a "bye" (or miss) for the group that is short a player. Alternatively, the system 100 may rotate through each team, ensuring a team member is assigned to each round. The system 100 may also provide each opposing team how player data is displayed to the team members. For example, a Team Report may display team-related statistical data related to the match, tournament, league, and/or team history. A Group Report may provide data for an identified Doubles/Triples/Quads, etc. team. A Player Report may provide individual darts and accomplishments data, assigned to each player, regardless of whether they are involved in any team or group play. Examples of these reports may be seen in FIGS. 24 & 25.

Figure 15:
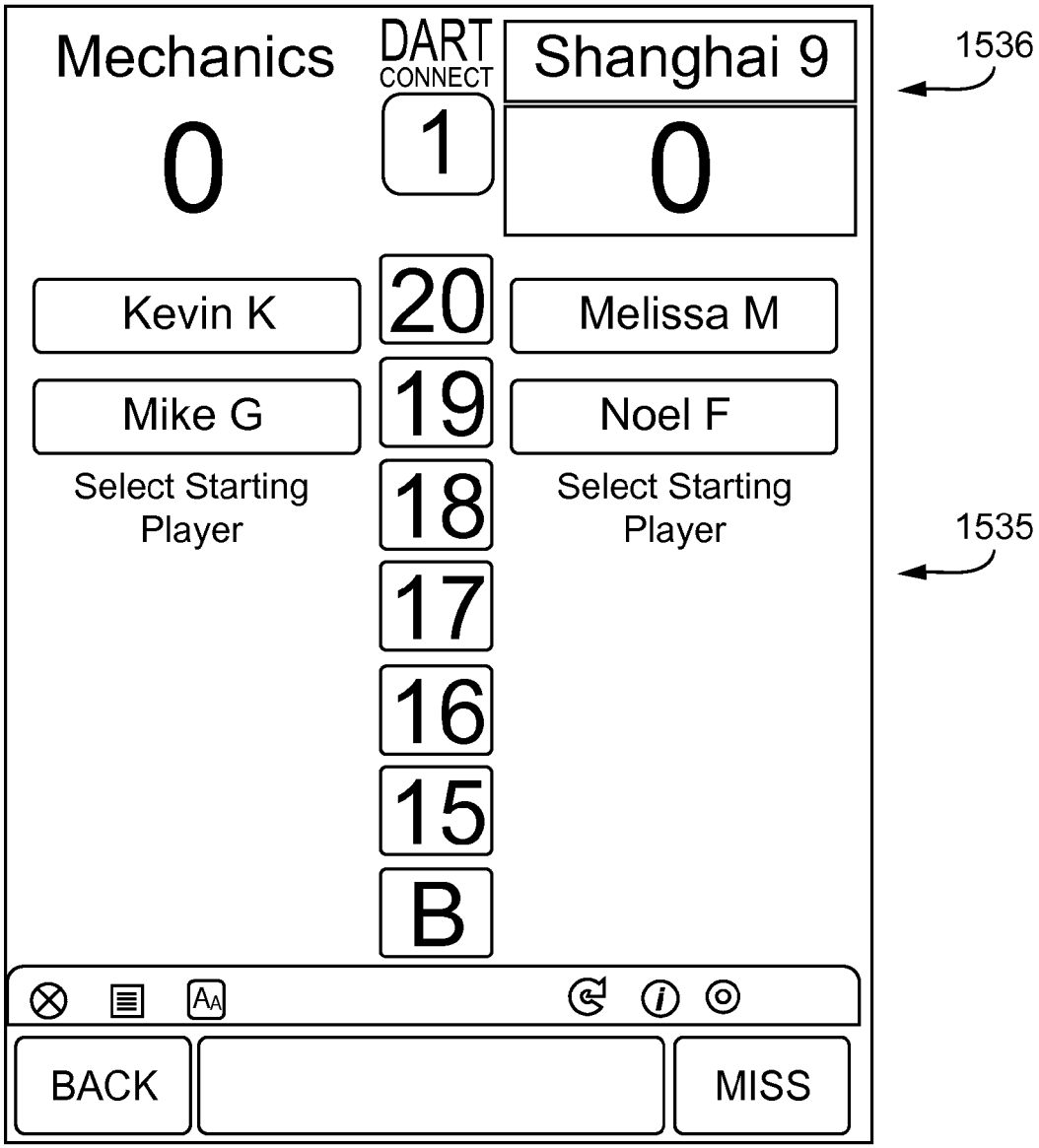
FIG. 15 depicts a game start screen according to one embodiment of the invention.

Turning now to FIG. 15, seen is how to select a starting player. After choosing the teams through the edit teams selection, selecting team members from each team to participate in the game from the team lists and connecting, the game start screen 1535 is shown. In the game start screen 1535, the selected players are listed and the user selects the play order for each group. This is done by touching or selecting each player in each team in the order which they will participate in the match. Selecting the player order allows the system 100 to assign the entered dart throw data and corresponding stats and achievements to each individual player, as opposed to a generic "pairing" or group. Dart throw data may be entered through one of the screens seen in FIGS. 4-11B, or any other screen, depending on the dart game being played. During group play, the system 100 alternates between opposing teams, listing which player is currently throwing. For example, the player name may be listed at the top 1536 of the screen in lieu of, or in addition to, listing the team name.

The system 100 may also create and provide custom menus for leagues and tournaments to reflect their exact format. One benefit of this would be fewer game set-up decisions (game type and options) that need to be made by the score keeper and players. When playing an accepted league format, upon launching the system 100 on a mobile computing device, players may be greeted with a simplified menu, such as, but not limited to, the menu 1626 seen in FIG. 16. Such a menu 1626 would substantially eliminate the need to format each game prior to game start. One such menu 1626 may display the league name 1627, acronym and/or logo to reinforce the league brand and assure users they are playing the correct format. Also listed are various game options 1628.

Figure 17:
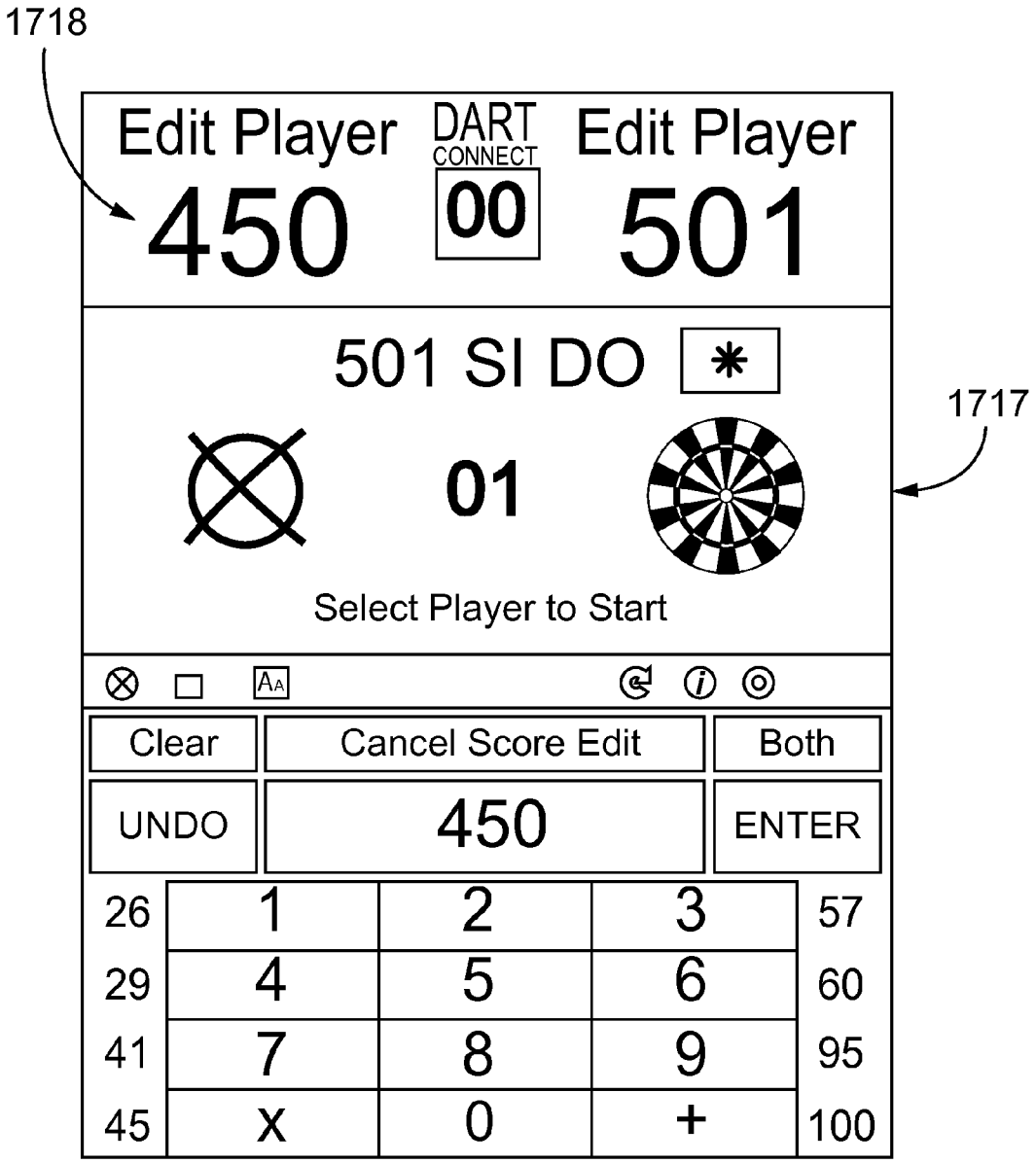
FIG. 17 depicts handicapping and custom scoring screen according to one embodiment of the invention.

Looking now at FIG. 17, seen is a handicapping and custom score chart 1717. Users have the ability with this chart 1717 to modify their starting score to create any custom game or to handicap one of the opponents. In one embodiment, prior to starting any game, a user can adjust the starting points, by simply tapping the starting score 1718 in the header. The system may allow you to input the starting total (point games) or pre-scored marks (cricket and target games) for either player. Users may also have the option of allowing the system to automatically determine the appropriate handicap for a given match up, based on their historical performance.

Figure 18:
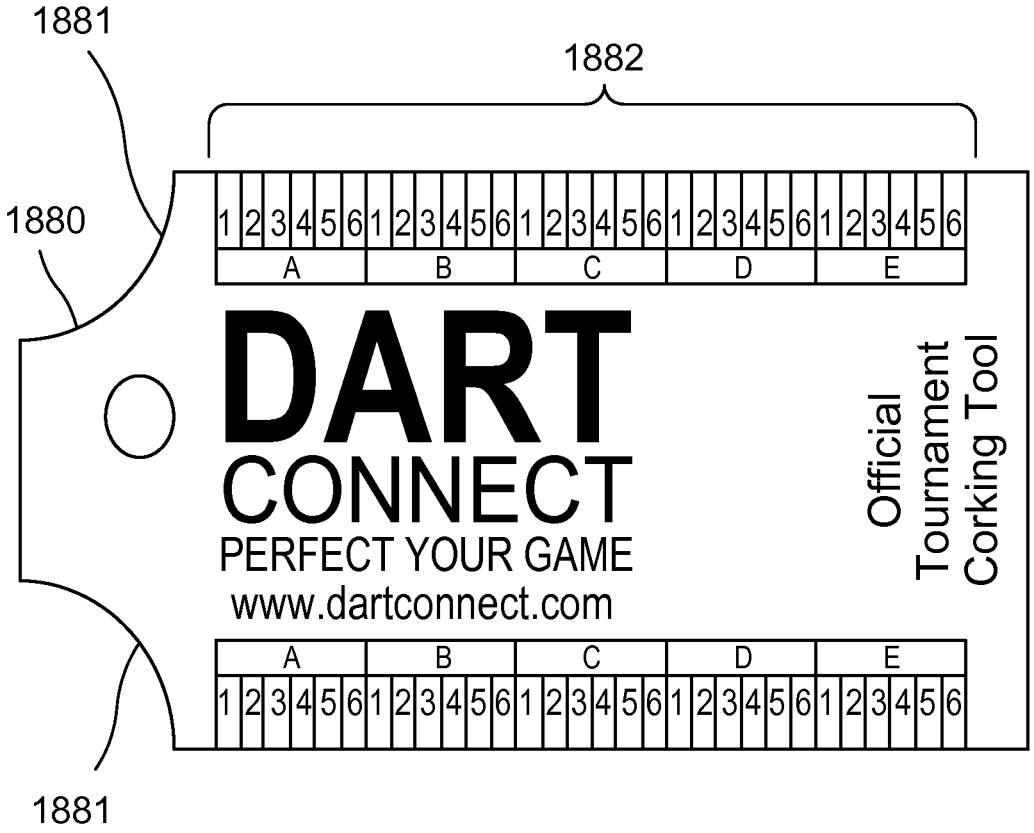
FIG. 18 depicts a corking tool according to one embodiment of the invention.

One system 100 seen in FIG. 1 may also comprise a corking tool 1880, as seen in FIG. 18. Such a tool may be used to determine who throws first in a dart game. Prior to game play, each player often throws a single dart at the bulls-eye of a dart board & the player with the closest dart throws first. In order to determine who is the closest to the bulls-eye, the corking tool 1880 seen in FIG. 18 was created. The arcs 1881 on the corking tool 1880 are shaped to align with the outer ring on the bulls-eye of a dart board. Using the measurement markings 1882 along the edges of the corking tool 1880, a user may determine what distance the dart is located from the outer ring of the bulls-eye, and compare such distance with a distance of another player, potentially playing from a remote location. As seen, the measurement markings 1882 are divided up into six lettered sections (A-D), with each lettered section being divided up into six separate numbered sections (1-6). The player with the smallest distance to the bull eye would throw first.

Figure 28:
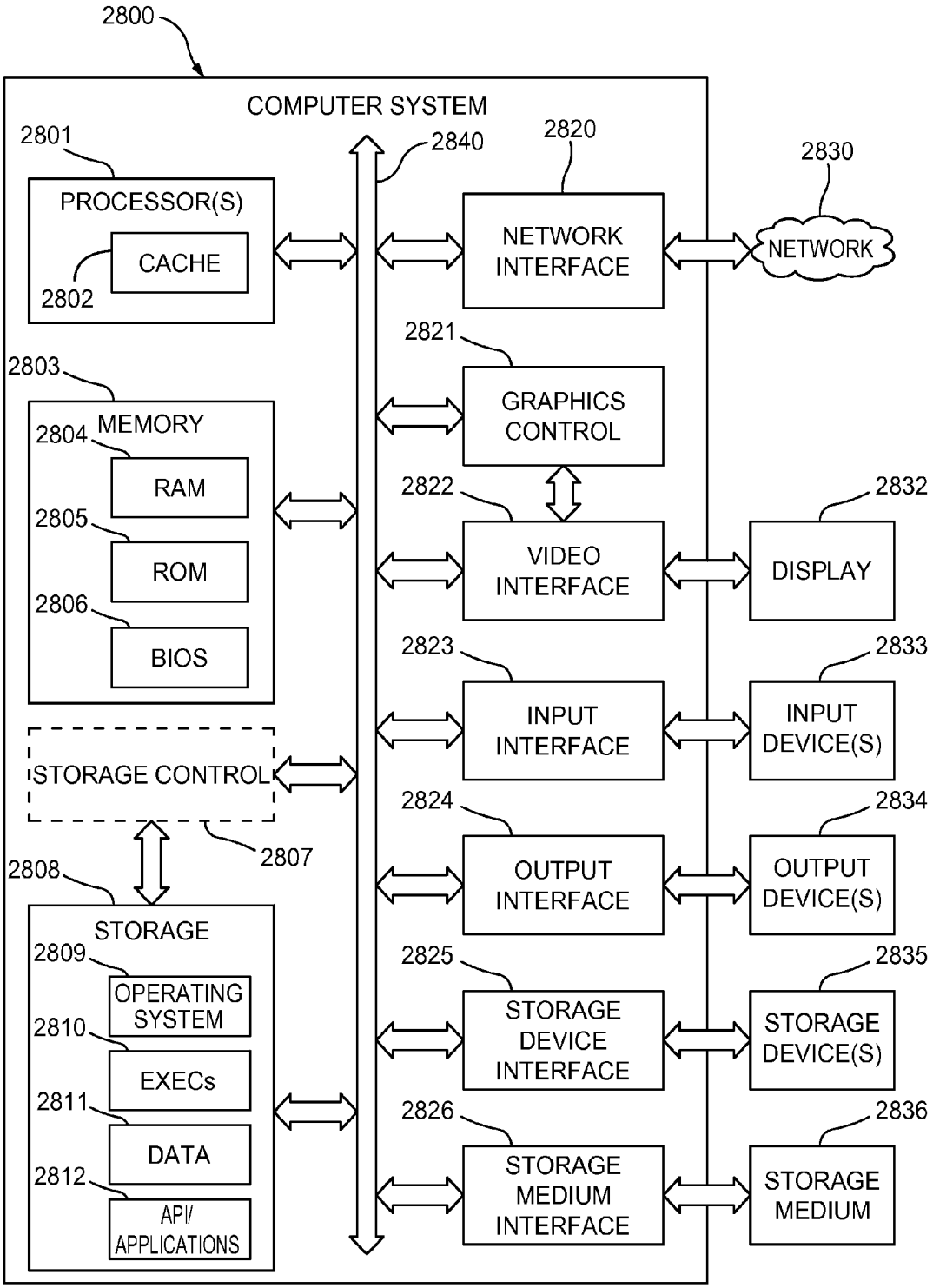
FIG. 28 depicts a diagrammatic representation of one embodiment of a computer system according to one embodiment of the invention.
Figure 29:
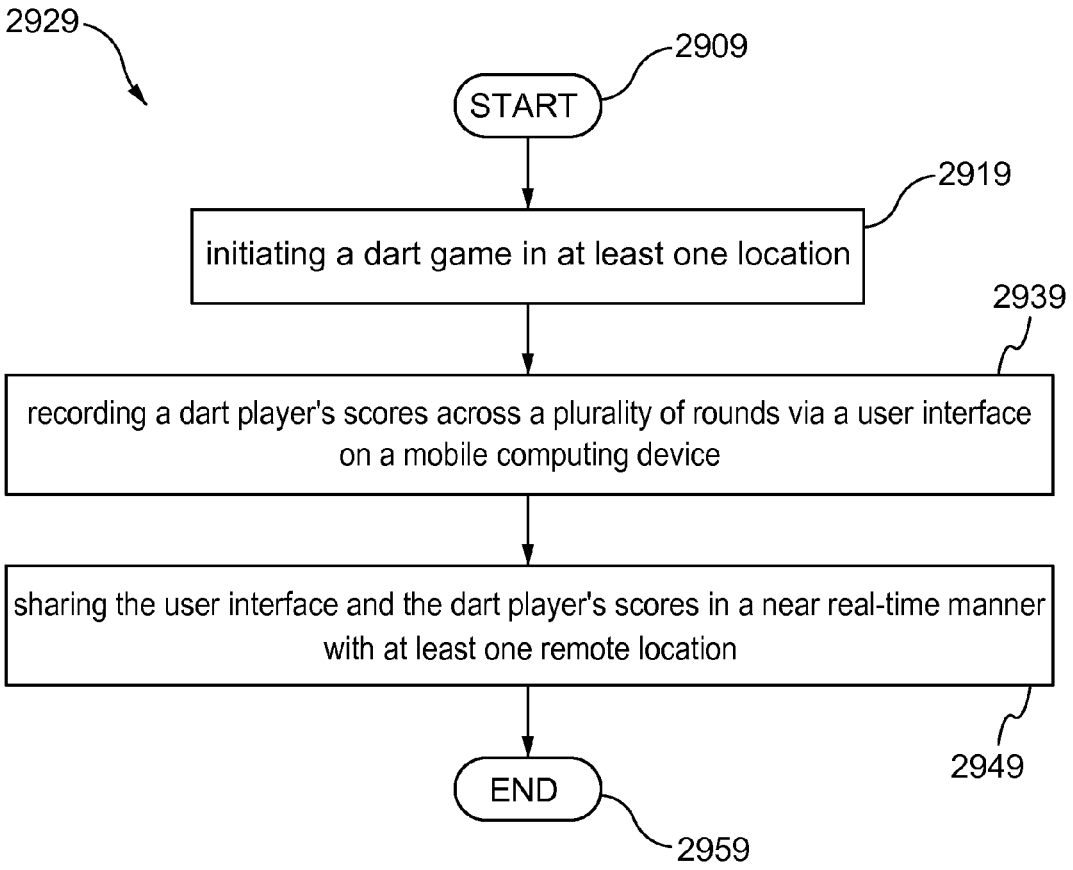
FIG. 29 depicts a method according to one embodiment of the invention.

Turning now to FIG. 29, seen is method 2929 of conducting a dart game. The dart game referred to in method 2929 may comprise any of the dart games referred to in any of FIGS. 1-28 such as, but not limited to, '01 and cricket. One method starts at 2909 and at 2919 comprises initiating a dart game in at least one location. For example, the location of the scoreboard 112 may comprise such a location. At 2939, the method comprises recording a dart player's scores across a plurality of rounds via a user interface on a mobile computing device. For example, the user interface may be any of the scoring interfaces described above such as, but not limited to, the '01 interface seen in FIG. 4 or the cricket interface see in FIG. 7. At 2949, the method 2929 comprises sharing the user interface and the dart player's scores in a near real-time manner with at least one remote location. Such a remote location may be the off-site devices 120 seen in FIG. 1.

Although not explicitly listed in FIG. 29, it is contemplated that the user interface in the method 292 may comprise a first display screen, with the first display screen comprising a game creation option, a game join option, a game share option, and a game watch option. For example, and as seen in FIG. 20 is the launch screen 2050, which may comprise the first display screen. Through the launch screen 2050, as use may create a game through the "play" feature (i.e., a game creation option), may join a game through the "connect" 2131 feature (or as otherwise described herein) after selecting any of the league, play, or another other of the options on the screen 2050, and may comprise a game watch option.

Whatever dart game is chosen may comprise a first dart game. One method 2929 may further comprise initiating a second dart game. For example, the first and second dart games may be related to a league and/or event/tournament, as seen in FIG. 20. One or more statistics may be obtained for the first dart game and the second dart game (as well as any additionally-related dart games, as identified by the player in the user settings 1919 or otherwise), aggregating the one or more statistics from the first dart game and the second dart game into a plurality of statistics for the dart player/league/tournament/event, and ranking at least a portion of the plurality of statistics for the dart player against one or more additional dart players/leagues/tournaments/events.

The method 292 may further comprise providing match summary information to the dart player upon conclusion of the match—for example in a message with a link as shown in FIG. 26. Game detail information may be provided to the dart player upon conclusion of the match. Player performance information may also be provided to at least one of the dart player and the at least one remote location one of during the match and upon conclusion of the match. Such information may be seen in FIGS. 25, 26, as well as FIGS. 9, 5, and 6. Further methods 292 may comprise storing the dart player's scores related to each of the plurality of rounds in the server 180, choosing to play a game against game stored in the server, and/or utilizing a server device to share the user interface and the dart player's scores in a near real-time manner with at least one additional location.

Embodiments of the invention may further comprise a non-transitory, tangible, computer-readable storage medium, encoded with processor-readable instructions to perform a method of providing information related to a dart game. One non-transitory, tangible, computer-readable storage medium, encoded with processor-readable instructions may be described with reference to FIG. 28, below. One such method may comprise rendering a dart game scoring interface on a mobile computing device. One dart game scoring interface may comprise the various scoring interfaces and display screens shown in the figures and described herein. One such interface may display at least one current player score and at least one another player score. The method may further comprise ensuring that a dart score is entered correctly into the dart game scoring interface. For example, a color of the at least one current player score (the player currently entering scoring data) may be differentiated from the color of the at least one another player's score. Additionally, each entry to the scoring interface may be displayed in a scoring interface score window. Also, the method may comprise at least one of (i) displaying in an audit trail a sum of each previous entry entered into the score window, and (ii) displaying a number of times a user has selected a target. The method may also comprise sharing the dart game scoring interface with a plurality of additional mobile computing devices.

It is contemplated that a portion of the at least one current player score comprises mark notations, as described herein. Furthermore, target on the dart board may comprise one of an enabled target and a disabled target. This may occur in a cricket game. For example, prior to both or all players hitting the target three times, after a player hits the target three times (receives three mark notations—two slashes and a circle), that player may receive a numerical score for the target amount for any subsequent hits (i.e., "selected" on the user interface) prior to the other player or players hitting the target three times. During this period, the target is enabled. After all players have hit the target three times, the target is disabled and not points may be obtain for this target by any player. The user interface may also comprise a first scoring redundancy and a second scoring redundancy, to ensure scoring accuracy. One such first redundancy may comprise differentiating a color of the enabled target from the disabled target. A second redundancy may comprise: (i) accessing one sum in the audit trail, (ii) differentiating the color of the accessed sum from each other sum, and (iii) displaying in the score window each previous entry related to the accessed sum.

The non-transitory tangible computer-readable storage medium method may further comprise requesting an event key, also referred to herein as a code or a password, or any other term known in the art. The event key may then be distributed to another computing device and then a dart game scoring interface may be received by the another computing device, as well as displaying score information on the interface. Such scoring information may be related to one or more forthcoming player dart throws for a next round. Such scoring information may be provided before or after the player has thrown at least one dart for the round. A fade-out display message may also provide information related to one or more recent dart throws to the plurality of additional mobile computing devices.

It is contemplated that ensuring that a dart score is entered correctly into the dart game scoring interface further comprises providing a series of selectable features that automatically enter a score related to a dart throw, decreasing a number of selections required to enter the score as compared to the number of selections required not using the series of selectable features, and calculating statistics related to the selectable features.

The systems and methods described herein can be implemented in a computer system in addition to the specific physical devices described herein. FIG. 28 shows a diagrammatic representation of one embodiment of a computer system 2800 within which a set of instructions can execute for causing a device to perform or execute any one or more of the aspects and/or methodologies of the present disclosure. A computer comprising the any of the devices disclosed with reference to FIG. 1, such as, but not limited to, the scoreboard 112 device, is one implementation of the computer system 2800. The components in FIG. 28 are examples only and do not limit the scope of use or functionality of any hardware, software, firmware, embedded logic component, or a combination of two or more such components implementing particular embodiments of this disclosure. Some or all of the illustrated components can be part of the computer system 2800. For instance, the computer system 2800 can be a general purpose computer (e.g., a laptop computer) or an embedded logic device (e.g., an FPGA), to name just two non-limiting examples.

Computer system 2800 includes at least a processor 2801 such as a central processing unit (CPU) or an FPGA to name two non-limiting examples. Any of the subsystems described throughout this disclosure could embody the processor 2801. The computer system 2800 may also comprise a memory 2803 and a storage 2808, both communicating with each other, and with other components, via a bus 2840. The bus 2840 may also link a display 2832, one or more input devices 2833 (which may, for example, include a keypad, a keyboard, a mouse, a stylus, etc.), one or more output devices 2834, one or more storage devices 2835, and various non-transitory, tangible computer-readable storage media 2836 with each other and with one or more of the processor 2801, the memory 2803, and the storage 2808. All of these elements may interface directly or via one or more interfaces or adaptors to the bus 2840. For instance, the various non-transitory, tangible computer-readable storage media 2836 can interface with the bus 2840 via storage medium interface 2826. Computer system 2800 may have any suitable physical form, including but not limited to one or more integrated circuits (ICs), printed circuit boards (PCBs), mobile handheld devices (such as mobile telephones or PDAs), laptop or notebook computers, distributed computer systems, computing grids, or servers.

Processor(s) 2801 (or central processing unit(s) (CPU(s))) optionally contains a cache memory unit 2802 for temporary local storage of instructions, data, or computer addresses. Processor(s) 2801 are configured to assist in execution of computer-readable instructions stored on at least one non-transitory, tangible computer-readable storage medium. Computer system 2800 may provide functionality as a result of the processor(s) 2801 executing software embodied in one or more non-transitory, tangible computer-readable storage media, such as memory 2803, storage 2808, storage devices 2835, and/or storage medium 2836 (e.g., read only memory (ROM)). For instance, the methods 2929 in FIG. 29 may be embodied in one or more non-transitory, tangible computer-readable storage media. The non-transitory, tangible computer-readable storage media may store software that implements particular embodiments, such as the method 2929 and processor(s) 2801 may execute the software. Memory 2803 may read the software from one or more other non-transitory, tangible computer-readable storage media (such as mass storage device(s) 2835, 2836) or from one or more other sources through a suitable interface, such as network interface 2820. Any of the subsystems herein disclosed could include a network interface such as the network interface 2820. The software may cause processor(s) 2801 to carry out one or more processes or one or more steps of one or more processes described or illustrated herein. Carrying out such processes or steps may include defining data structures stored in memory 2803 and modifying the data structures as directed by the software. In some embodiments, an FPGA can store instructions for carrying out functionality as described in this disclosure (e.g., the method 2929). In other embodiments, firmware includes instructions for carrying out functionality as described in this disclosure (e.g., the method 2929).

The memory 2803 may include various components (e.g., non-transitory, tangible computer-readable storage media) including, but not limited to, a random access memory component (e.g., RAM 2804) (e.g., a static RAM "SRAM", a dynamic RAM "DRAM, etc.), a read-only component (e.g., ROM 2805), and any combinations thereof. ROM 2805 may act to communicate data and instructions unidirectionally to processor(s) 2801, and RAM 2804 may act to communicate data and instructions bidirectionally with processor(s) 2801. ROM 2805 and RAM 2804 may include any suitable non-transitory, tangible computer-readable storage media. In some instances, ROM 2805 and RAM 2804 include non-transitory, tangible computer-readable storage media for carrying out the method 2929. In one example, a basic input/output system 2806 (BIOS), including basic routines that help to transfer information between elements within computer system 2800, such as during start-up, may be stored in the memory 2803.

Fixed storage 2808 is connected bidirectionally to processor(s) 2801, optionally through storage control unit 2807. Fixed storage 2808 provides additional data storage capacity and may also include any suitable non-transitory, tangible computer-readable media described herein. Storage 2808 may be used to store operating system 2809, EXECs 2810 (executables), data 2811, API applications 2812 (application programs), and the like. Often, although not always, storage 2808 is a secondary storage medium (such as a hard disk) that is slower than primary storage (e.g., memory 2803). Storage 2808 can also include an optical disk drive, a solid-state memory device (e.g., flash-based systems), or a combination of any of the above. Information in storage 2808 may, in appropriate cases, be incorporated as virtual memory in memory 2803.

In one example, storage device(s) 2835 may be removably interfaced with computer system 2800 (e.g., via an external port connector (not shown)) via a storage device interface 2825. Particularly, storage device(s) 2835 and an associated machine-readable medium may provide nonvolatile and/or volatile storage of machine-readable instructions, data structures, program modules, and/or other data for the computer system 2800. In one example, software may reside, completely or partially, within a machine-readable medium on storage device(s) 2835. In another example, software may reside, completely or partially, within processor(s) 2801.

Bus 2840 connects a wide variety of subsystems. Herein, reference to a bus may encompass one or more digital signal lines serving a common function, where appropriate. Bus 2840 may be any of several types of bus structures including, but not limited to, a memory bus, a memory controller, a peripheral bus, a local bus, and any combinations thereof, using any of a variety of bus architectures. As an example and not by way of limitation, such architectures include an Industry Standard Architecture (ISA) bus, an Enhanced ISA (EISA) bus, a Micro Channel Architecture (MCA) bus, a Video Electronics Standards Association local bus (VLB), a Peripheral Component Interconnect (PCI) bus, a PCI-Express (PCI-X) bus, an Accelerated Graphics Port (AGP) bus, HyperTransport (HTX) bus, serial advanced technology attachment (SATA) bus, and any combinations thereof.

Computer system 2800 may also include an input device 2833. In one example, a user of computer system 2800 may enter commands and/or other information into computer system 2800 via input device(s) 2833. Examples of an input device(s) 2833 include, but are not limited to, an alphanumeric input device (e.g., a keyboard), a pointing device (e.g., a mouse or touchpad), a touchpad, a joystick, a gamepad, an audio input device (e.g., a microphone, a voice response system, etc.), an optical scanner, a video or still image capture device (e.g., a camera), and any combinations thereof. Input device(s) 2833 may be interfaced to bus 2840 via any of a variety of input interfaces 2823 (e.g., input interface 2823) including, but not limited to, serial, parallel, game port, USB, FIREWIRE, THUNDERBOLT, or any combination of the above.

In particular embodiments, when computer system 2800 is connected to network 2830, computer system 2800 may communicate with other devices, such as mobile devices and enterprise systems, connected to network 2830. Communications to and from computer system 2800 may be sent through network interface 2820. For example, network interface 2820 may receive incoming communications (such as requests or responses from other devices) in the form of one or more packets (such as Internet Protocol (IP) packets) from network 2830, and computer system 2800 may store the incoming communications in memory 2803 for processing. Computer system 2800 may similarly store outgoing communications (such as requests or responses to other devices) in the form of one or more packets in memory 2803 and communicated to network 2830 from network interface 2820. Processor(s) 2801 may access these communication packets stored in memory 2803 for processing.

Examples of the network interface 2820 include, but are not limited to, a network interface card, a modem, and any combination thereof. Examples of a network 2830 or network segment 2830 include, but are not limited to, a wide area network (WAN) (e.g., the Internet, an enterprise network), a local area network (LAN) (e.g., a network associated with an office, a building, a campus or other relatively small geographic space), a telephone network, a direct connection between two computing devices, and any combinations thereof. A network, such as network 2830, may employ a wired and/or a wireless mode of communication. In general, any network topology may be used.

Information and data can be displayed through a display 2832. Examples of a display 2832 include, but are not limited to, a liquid crystal display (LCD), an organic liquid crystal display (OLED), a cathode ray tube (CRT), a plasma display, and any combinations thereof. The display 2832 can interface to the processor(s) 2801, memory 2803, and fixed storage 2808, as well as other devices, such as input device(s) 2833, via the bus 2840. The display 2832 is linked to the bus 2840 via a video interface 2822, and transport of data between the display 2832 and the bus 2840 can be controlled via the graphics control 2821.

In addition to a display 2832, computer system 2800 may include one or more other peripheral output devices 2834 including, but not limited to, an audio speaker, a printer, and any combinations thereof. Such peripheral output devices may be connected to the bus 2840 via an output interface 2824. Examples of an output interface 2824 include, but are not limited to, a serial port, a parallel connection, a USB port, a FIREWIRE port, a THUNDERBOLT port, and any combinations thereof.

In addition or as an alternative, computer system 2800 may provide functionality as a result of logic hardwired or otherwise embodied in a circuit, which may operate in place of or together with software to execute one or more processes or one or more steps of one or more processes described or illustrated herein. Reference to software in this disclosure may encompass logic, and reference to logic may encompass software. Moreover, reference to a non-transitory, tangible computer-readable medium may encompass a circuit (such as an IC) storing software for execution, a circuit embodying logic for execution, or both, where appropriate. The present disclosure encompasses any suitable combination of hardware, software, or both.

Those of skill in the art will understand that information and signals may be represented using any of a variety of different technologies and techniques. Those of skill will further appreciate that the various illustrative logical blocks, modules, circuits, and algorithm steps described in connection with the embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present disclosure.

The various illustrative logical blocks, modules, and circuits described in connection with the embodiments disclosed herein may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The steps of a method or algorithm described in connection with the embodiments disclosed herein (e.g., the method 2929) may be embodied directly in hardware, in a software module executed by a processor, a software module implemented as digital logic devices, or in a combination of these. A software module may reside in RAM memory, flash memory, ROM memory, EPROM memory, EEPROM memory, registers, hard disk, a removable disk, a CD-ROM, or any other form of non-transitory, tangible computer-readable storage medium known in the art. An exemplary non-transitory, tangible computer-readable storage medium is coupled to the processor such that the processor can read information from, and write information to, the non-transitory, tangible computer-readable storage medium. In the alternative, the non-transitory, tangible computer-readable storage medium may be integral to the processor. The processor and the non-transitory, tangible computer-readable storage medium may reside in an ASIC. The ASIC may reside in a user terminal. In the alternative, the processor and the non-transitory, tangible computer-readable storage medium may reside as discrete components in a user terminal. In some embodiments, a software module may be implemented as digital logic components such as those in an FPGA once programmed with the software module.

The previous description of the disclosed embodiments is provided to enable any person skilled in the art to make or use the present disclosure. Various modifications to these embodiments will be readily apparent to those skilled in the art, and the generic principles defined herein may be applied to other embodiments without departing from the spirit or scope of the disclosure. Thus, the present disclosure is not intended to be limited to the embodiments shown herein but is to be accorded the widest scope consistent with the principles and novel features disclosed herein.

What is claimed is:

1. A dart game scoring system comprising, at least one first mobile computing scoring device comprising a scoring interface configured to accept scoring inputs from a first user on a touchscreen of the first mobile computer scoring device;

a remote server adapted to receive the scoring inputs from the first mobile computer scoring device; and a remote computing device adapted to receive the scoring inputs from the at least one first mobile computing scoring device via the remote server for display of real-time dart game scores at a remote location, wherein the dart game scoring system is configured to operate in at least two modes, the two modes comprising each of:

a match mode, wherein the remote computing device is configured to accept scoring inputs from a second user on a touchscreen of the remote computing device; and a viewing mode, wherein the remote computing device is configured to view a match being scored on the at least one first mobile computing scoring device, and wherein the scoring interface is further configured to:

display at least one current player score and at least one another player score;

ensure that a dart score is entered correctly into the scoring interface by:

differentiating a color of the at least one current player score from the at least one another player score, and displaying each new scoring entry to the scoring interface in a scoring interface score window while contemporaneously displaying an audit trail comprising a plurality of previous entries and a sum of the plurality of previous entries entered into the score window.

2. The dart game system of claim 1 wherein:

the scoring interface comprises a first display screen;

the first display screen provides a game creation option and a game join option;

the game creation option comprises a password; and the game join option comprises each of:

a field to enter the password and receive the scoring interface for a private dart match on the remote computing device, and a link to view the scoring interface for a public dart match on the remote computing device.

3. The dart game system of claim 1 wherein, the at least one first mobile computing scoring device comprises a plurality of scoring devices participating in at least one of a:

dart tournament, and dart league;

the scoring interface:

comprises scoring information, and displays one or more metrics related to at least one of:

a player, and the at least one of a:

dart tournament, dart league; and further comprising, an event device, wherein, the event device receives the scoring information in the scoring interface.

4. The dart game system of claim 3 wherein the one or more metrics comprise at least one of:

description of an event, match or player;
analysis of an event, match or player;
summary of an event, match or player;
accomplishment of an event, match or player; and
statistics related to an event, match or player.

5. The dart game system of claim 1 wherein, the scoring interface comprises at least one of:
a plurality of scoring redundancy features;
an opponent locator feature;
a game rule modification feature;
a historical game play feature; and
a game design feature.

6. The dart game system of claim 1 wherein, the scoring interface:
comprises one of an '01-game and a cricket-game scoring interface; and
displays information related to a suggested dart placement for a next upcoming dart throw.

7. The dart game scoring system of claim 1, further comprising:
a second mobile computing scoring device, wherein the match being scored on the at least one first mobile computing scoring device is also being scored on the second mobile computing device.

8. The dart game scoring system of claim 7, wherein a broadcast key is provided to allow the remote computing device to view the match being scored.

9. The dart game scoring system of claim 1, wherein the scoring interface on the first mobile computing scoring device comprises a historical game play feature, the historical game play feature configured to allow the first user to:
select a previously played and scored game saved in a memory;
play and score a simulated game against the previously played and scored game.

10. A method of conducting a dart game comprising:
initiating a dart game in at least one location;
recording a dart player's scores across a plurality of rounds via a user interface on a mobile computing device;
scoring the dart game by displaying:
at least one current player score and
at least one another player score;
ensuring that a dart score is entered correctly into the user interface by:
differentiating a color of the at least one current player score from the at least one another player score, and
displaying each new scoring entry to the user interface in a scoring interface score window while contemporaneously
displaying an audit trail comprising a plurality of previous entries and a sum of the plurality of previous entries entered into the score window;
sending the scores to a remote server adapted to receive the scoring inputs from the first mobile computer scoring device and
selecting how to share the user interface and the dart player's scores with at least one remote computing device from one of at least two modes, the two modes comprising each of:
a match mode, wherein the remote computing device is configured to accept scoring inputs from a second dart player on a touchscreen of the remote computing device; and
a viewing mode, wherein the remote computing device is configured to view a match being scored on the at least one first mobile computing scoring device; and
sharing the user interface and the dart player's scores in a near real-time manner.

11. The method of claim 10 wherein:
the user interface comprises a first display screen;
the first display screen comprises:
a game creation option,
a game join option,
a game share option, and
a game watch option.

12. The method of claim 10 wherein, the dart game comprises a first dart game, and further comprising:
initiating a second dart game;
obtaining one or more statistics for the first dart game and the second dart game;
aggregating the one or more statistics from the first dart game and the second dart game into a plurality of statistics for the dart player; and
ranking at least a portion of the plurality of statistics for the dart player against one or more additional dart players.

13. The method of claim 12 wherein, the one or more statistics comprises statistics related to at least one of a:
tournament; and
league.

14. The method of claim 10 further comprising:
providing match summary information to the dart player upon conclusion of the match;
providing game detail information to the dart player upon conclusion of the match; and
providing player performance information to at least one of the dart player and the at least one remote location one of:
during the match, and
upon conclusion of the match.

15. The method of claim 10 further comprising:
storing the dart player's scores related to each of the plurality of rounds; and
choosing to play a game against the dart player's scores related to each of the plurality of rounds.

* * * * *